United States Patent [19]

McCullough

[11] 4,129,405

[45] Dec. 12, 1978

[54] SCROLL-TYPE LIQUID PUMP WITH TRANSFER PASSAGES IN END PLATE

[75] Inventor: John E. McCullough, Carlisle, Mass.

[73] Assignee: Arthur D. Little, Inc., Cambridge, Mass.

[21] Appl. No.: 807,413

[22] Filed: Jun. 17, 1977

[51] Int. Cl.[2] ..... F04C 11/02; F04C 15/02; F01C 21/04; F01C 21/06

[52] U.S. Cl. ..... 418/55; 418/88; 418/101; 418/151

[58] Field of Search ..... 418/55, 59, 189, 88, 418/101, 151

[56] References Cited

U.S. PATENT DOCUMENTS

| | | | |
|---|---|---|---|
| 465,050 | 12/1891 | Rand et al. | 418/59 |
| 3,302,623 | 2/1967 | Zimmermann | 418/101 |
| 3,802,809 | 4/1974 | Vulliez | 418/88 |
| 3,817,664 | 6/1974 | Bennett et al. | 418/55 |
| 3,884,599 | 5/1975 | Young et al. | 418/55 |

*Primary Examiner*—John J. Vrablik
*Attorney, Agent, or Firm*—Bessie A. Lepper

[57] ABSTRACT

Scroll apparatus for pumping liquids wherein recessed liquid transfer passage means are provided in the end plates of the scroll members. The transfer passage means may be inner passages within the scroll involutes, outer passages outside the scroll involutes or a combination of inner and outer passages. These passages are located and configured to be opened substantially immediately after the orbiting involute wrap has reached that point in its orbiting cycle to define three essentially completely sealed-off liquid zones. These passages remain open at least until the liquid passages between the wraps are sufficiently large to prevent any substantial pressure pulsations within the scroll liquid pump. The scroll liquid pumps may be operated to pump liquid radially inward or outward.

46 Claims, 61 Drawing Figures

SCROLL-TYPE LIQUID PUMP WITH TRANSFER PASSAGES IN END PLATE

This invention relates to scroll-type apparatus and more particularly to scroll devices used as liquid pumps.

There is known in the art a class of devices generally referred to as "scroll" pumps, compressors and engines wherein two interfitting spiroidal or involute spiral elements of like pitch are mounted on separate end plates. These spiral elements are angularly and radially offset to contact one another along at least one pair of line contacts such as between spiral curved surfaces. A pair of line contacts will lie approximately upon one radius drawn outwardly from the central region of the scrolls to form one or more fluid volumes or pockets. The angular position of these pockets varies with relative orbiting of the spiral centers; and all pockets maintain the same relative angular position. As the contact lines shift along the scroll surfaces, the pockets thus formed experience a change in volume. In compressors and expansion engines there are thus created zones of lowest and highest pressures which are connected to fluid ports. In liquid pumps the volume ratio remains unity throughout. The outermost and innermost pockets are connected to liquid ports, and the flow of liquid may be either outwardly from the innermost pocket or inwardly from the outermost pocket.

An early patent to Creux (U.S. Pat. No. 801,182) describes scroll-type apparatus in general. Among the prior art patents disclosing scroll apparatus, a number of them have mentioned the interchangeable use of such devices as compressors, expanders and pumps. Several prior art patents have been directed either wholly or in part to scroll devices as liquid pumps (see for example U.S. Pat. Nos. 2,841,089, 2,921,534, 3,600,114 and 3,817,664). Even though this type of liquid pump has been known for a relatively long time, the scroll pump has not been able to compete with centrifugal pumps or with such positive displacement pumps as those incorporating pistons or rotary elements. Thus, although centrifugal pumps may exhibit low efficiencies, and conventional positive displacement pumps are relatively expensive to manufacture, these two types of pumps are widely used while the scroll pumps remain a more-or-less mechanical curiosity. This situation is believed to exist, in spite of the fact that scroll pumps should have high efficiencies and should be economical to construct, because the scroll pumps of the prior art develop very high pressure pulses.

The sealing problems encountered in scroll compressors and expanders (see for example U.S. Pat. Nos. 3,874,827, 3,884,599, 3,924,977, 3,994,633 and 3,994,636) are of lesser consequence for liquid pumps because liquids have higher viscosities than gases, and it is therefore possible to design scroll liquid pumps that have larger gaps between the scroll elements than can be tolerated in scroll compressors and expanders and still maintain acceptably low leakage consistent with high efficiency. Moreover, most of the mechanism associated with driving a scroll liquid pump can be smaller and more compact than that required for a gas compressor since operating temperatures are lower due to the liquid's being a coolant, and friction power dissipation is more easily accomplished. Being able to operate at lower temperatures also means that scroll liquid pumps may be formed of molded plastic parts. Finally, in many cases, e.g., fuel or oil pumps, the liquid being pumped acts as a lubricant. Thus, scroll liquid pumps offer many advantages; but these advantages can not be realized in practice in the form of commercially acceptable devices until such scroll liquid pumps can be made to operate at reasonable speeds (e.g., at least 1800 rpm) in an essentially pulsation-free manner. The scroll liquid pumps of this invention incorporate the means for either eliminating pressure pulses or for reducing such pressure pulses below that level where such pulses will adversely affect the performance and efficiency of the pumps.

It is therefore a primary object to provide unique scroll elements useable in the stationary and orbiting scroll members of a scroll liquid pump. Another object is to provide stationary and orbiting scroll members with porting means capable of reducing or eliminating pressure pulses in a scroll liquid pump.

It is another primary object of this invention to provide scroll devices useable as liquid pumps. It is another object to provide scroll liquid pumps which are capable of delivering a flow of liquid free from pulsations. Still a further object of this invention is to provide scroll liquid pumps of the character described which can be driven quietly at reasonably high speeds with maximum efficiency. An additional object is to provide scroll liquid pumps which are simple and economical to construct which may be formed in part from plastics, for example, by such techniques as molding, and which may be made in a wide range of sizes. Other objects of the invention will in part be obvious and will in part be apparent hereinafter.

According to one aspect of this invention there is provided a scroll liquid pump element comprising an end plate; an involute wrap of one and one-half involute turns affixed to one surface of the end plate; and recessed liquid transfer passage means cut in the one surface of the end plate. The recessed liquid transfer passage means is defined along one principal boundary by a partial tracing of an involute wrap edge of a mating scroll element. This transfer passage means may be an inner passage located within the involute wrap in which case it has as another principal boundary a straight line drawn through the center of the end plate and parallel to a line of contact drawn as a tangent to the generating radius of the involute wrap; or it may be an outer passage located outside the involute wrap in which case it has as another principal boundary a line following the same contour as the principal boundary and spaced radially outward therefrom. Alternatively, the liquid transfer passage means may be a combination of these inner and outer passages.

According to another aspect of this invention there are provided mating scroll members suitable for incorporation into a scroll liquid pump, comprising in combination a stationary scroll member having a central liquid port and comprising a stationary end plate, a stationary involute wrap of one and one-half involute turns affixed to one surface of the stationary end plate, and stationary recessed liquid transfer passage means cut in the surface of the stationary end plate; and an orbiting scroll member arranged to be orbited with respect to the stationary scroll member by driving means and comprising an orbiting end plate, an orbiting involute wrap of one and one-half involute turns affixed to the surface of the orbiting end plate, and orbiting recessed liquid transfer passage means cut in the surface of the orbiting end plate; whereby when the orbiting scroll member is driven by the driving means, the stationary and orbiting involute wraps define moving liquid pockets of variable volume, a peripheral volume around the pockets and a central liquid zone. The stationary and orbiting recessed liquid transfer passage means are located and configured to be opened substantially immediately after the orbiting involute wrap has reached that point in its orbiting cycle to define three essentially completely sealed-off liquid zones and to remain open at least until the liquid passages between the wraps are sufficiently large to prevent any substantial pressure pulsations within the scroll liquid pump in which the scroll members are incorporated. As noted above, the liquid transfer passage means may be an inner passage, an outer passage or a combination of inner and outer passages depending upon their location with respect to the involute wraps.

According to yet another aspect of this invention there is provided a positive displacement scroll liquid pump, comprising in combination a stationary scroll member having an end plate, an involute wrap of one and one-half involute turns and recessed liquid transfer passage means cut in the end plate; a mating orbiting scroll member having an end plate, an involute wrap of one and one-half involute turns and recessed liquid transfer passage means cut in the end plate; axial force applying means arranged to urge the scroll members into axial contact; coupling means to maintain the scroll members in fixed angular relationship; liquid inlet conduit means and liquid discharge conduit means; and driving means for orbiting the orbiting scroll member whereby the flanks of the involute wraps along with the end plates on which the involute wraps are mounted define moving liquid pockets of variable volume, a peripheral volume around the pockets and a central liquid zone. The recessed liquid transfer passage means cut in the end plates of the stationary and orbiting scroll members are located and configured to be opened substantially immediately after the involute wrap of the orbiting scroll member has reached that point in its orbiting cycle to define three essentially completely sealed-off liquid pockets and to remain open at least until the liquid passages defined by the orbiting of the involute wrap of the orbiting scroll member and providing liquid communication into the liquid discharge zone are sufficiently large to prevent any substantial pressure pulsations within the pump. The liquid transfer passage means may be an inner passage, an outer passage or a combination of inner and outer passages depending upon their location with respect to the involute wraps. The liquid inlet and discharge conduit means may be in communication with the inner liquid pocket or the peripheral volume thus making it possible to operate the scroll liquid pump with the liquid flow being either radially inward or outward.

In a preferred embodiment of the scroll liquid pump of this invention, the driving means is arranged to effect the orbiting of the orbiting scroll member such that a small clearance is maintained between the side flanks of the involute wraps to essentially eliminate wear of the wraps over extended periods of operation.

The invention accordingly comprises the features of construction, combinations of elements, and arrangement of parts which will be exemplified in the constructions hereinafter set forth, and the scope of the invention will be indicated in the claims.

For a fuller understanding of the nature and objects of the invention, reference should be had to the following detailed description taken in connection with the accompanying drawings in which FIGS. 1 and 2 are top plan and cross sectional views of one embodiment of a stationary scroll element constructed in accordance with this invention and being particularly suited for use in a scroll liquid pump in which the liquid flow is inwardly directed;

Figure 2:
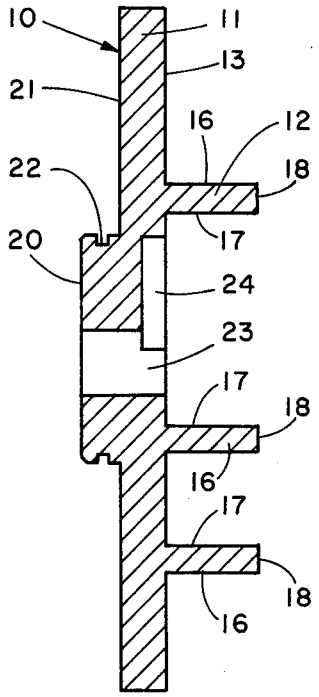

The principles of the operation of scroll apparatus have been presented in previously issued patents. (See for example U.S. Pat. No. 3,884,599.) It is therefore unnecessary to repeat a detailed description of the operation of such apparatus. It is only necessary to point out that a scroll-type apparatus operates by moving a sealed pocket of fluid taken from one region into another region which may be at a different pressure. If the fluid is compressed while being moved from a lower to higher pressure region, the apparatus serves as a compressor; if the fluid is expanded while being moved from a higher to lower pressure region it serves as an expander; and if the fluid pressure remains essentially constant independent of volume, then the apparatus serves as a pump.

The sealed pocket of fluid within the scroll apparatus is bounded by two parallel planes defined by end plates, and by two cylindrical surfaces defined by the involute of a circle or other suitably curved configuration. The scroll members have parallel axes since in only this way can the continuous sealing contact between the plane surface of the scroll members be maintained. A sealed pocket moves between these parallel planes as the two lines of contact between the cylindrical surfaces move. The lines of contact move because one cylindrical element, e.g., a scroll member, orbits within the other. This is accomplished, for example, by maintaining one scroll member stationary and orbiting the other scroll member.

Throughout the following description the term "scroll element" will be used to designate the basic component which is comprised of an end plate having the unique porting of this invention and the involute-shaped component which defines the contacting surfaces making movable line contacts. The term "wrap" will be used to designate the involute component making moving line contacts. These wraps have a configuration, e.g., an involute of a circle (involute spiral), arc of a circle, etc., and they have both height and thickness. Finally, the term "scroll member" will be applied to the entire stationary or orbiting component of which the stationary or orbiting scroll element is a part.

In the case of scroll apparatus used as compressors and expanders, the wraps of the scroll members may comprise any desired number of turns of an involute. However, a scroll liquid pump must be constructed so that each of the scroll members has a wrap of one and one-half turns of an involute. This requirement is dictated by the requirement that a scroll device designed to pump a liquid must have a compression ratio of exactly one. If the scroll apparatus has a compression ratio greater than one, it would attempt to compress the trapped liquid. Since liquids are essentially incompressible, any scroll pump operating with a compression ratio greater than one would jam and malfunction. Thus, in order for a scroll pump to have a compression ratio of one the members must have no more than one and one-half wraps of involute. This length of wrap achieves the desired continuity of seal between the peripheral zone and interior zone defined between the scroll members without compressing any of the trapped fluid. The need for scroll pump members to have wraps of one and one-half involute turns has been recognized in the prior art. (See for example U.S. Pat. Nos. 3,600,114 and 3,817,664.)

However, the limiting of the wraps to one and one-half involute turns is not the total solution to constructing an efficient, practical scroll liquid pump, for this does not solve the serious problem of pressure pulsations developed during the discharge of liquid from the pump. These pressure pulsations develop because the rate of change in the volume of the scroll pocket (whether centrally or peripherally located) which is in communication with the discharge port is greater than the rate of change in discharge area opening for that pocket. Therefore, driving the orbiting scroll member forward compresses the liquid in the discharging pocket, forces it through a narrow discharge gap, and thus develops an intermittent high-pressure pulse. Such pressure can be so great that it can damage the hardware forming the scroll members.

In small, relatively inefficient pumps operating at relatively slow speeds, it may be possible to tolerate some pressure pulsation; but in most applications for a liquid pump it should be capable of relatively pulsation-free delivery flow and of operating at reasonable speeds, e.g., 1800 rpm or greater.

The scroll pump of this invention achieves pulsation-free liquid pumping at relatively high flow rates through a novel porting arrangement. This porting relieves the pressure in the discharging pocket which gives rise to pulsations by providing a much more rapid opening of the discharge port than when the movement of the orbiting scroll member wrap is relied on solely to open it.

Since the liquid flow through a scroll pump may be from the peripheral zone inwardly to the central pocket or from the central pocket outwardly to the peripheral zone, the novel porting arrangement may be associated with the central pocket, the peripheral volume or both.

Figure 1:
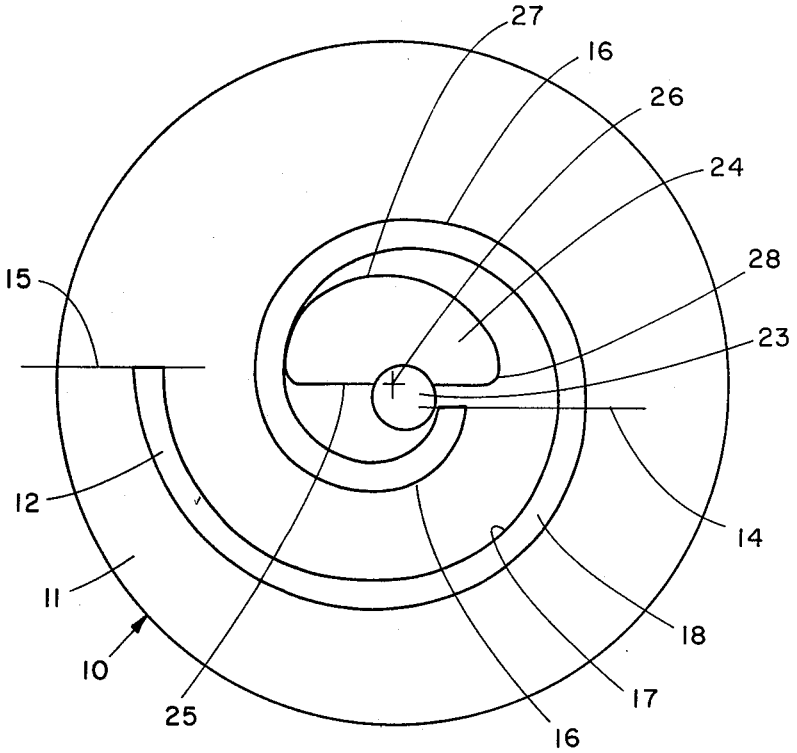

FIGS. 1–4 illustrate stationary and orbiting scroll elements suitable for incorporation into scroll members to form a scroll pump in which liquid flow is from the peripheral volume inwardly to the center pocket. The stationary scroll element 10 of FIG. 1 is comprised of an end plate 11 and an involute wrap 12 integral with or mounted on a separate member on the inner surface 13 of end plate 11 (see for example U.S. Pat. No. 3,994,635). Involute wrap 12 begins at a line of contact 14 which is drawn as a tangent to the involute generating radius and through the points of contact between the involutes of the fixed and orbiting scroll members, and it ends at a line of contact 15 which is also drawn as a tangent to the involute generating radius. Thus this wrap is formed of one and one-half turns of the involute; and it has an outer flank surface 16, an inner flank surface 17 and an end surface 18.

Figure 61:
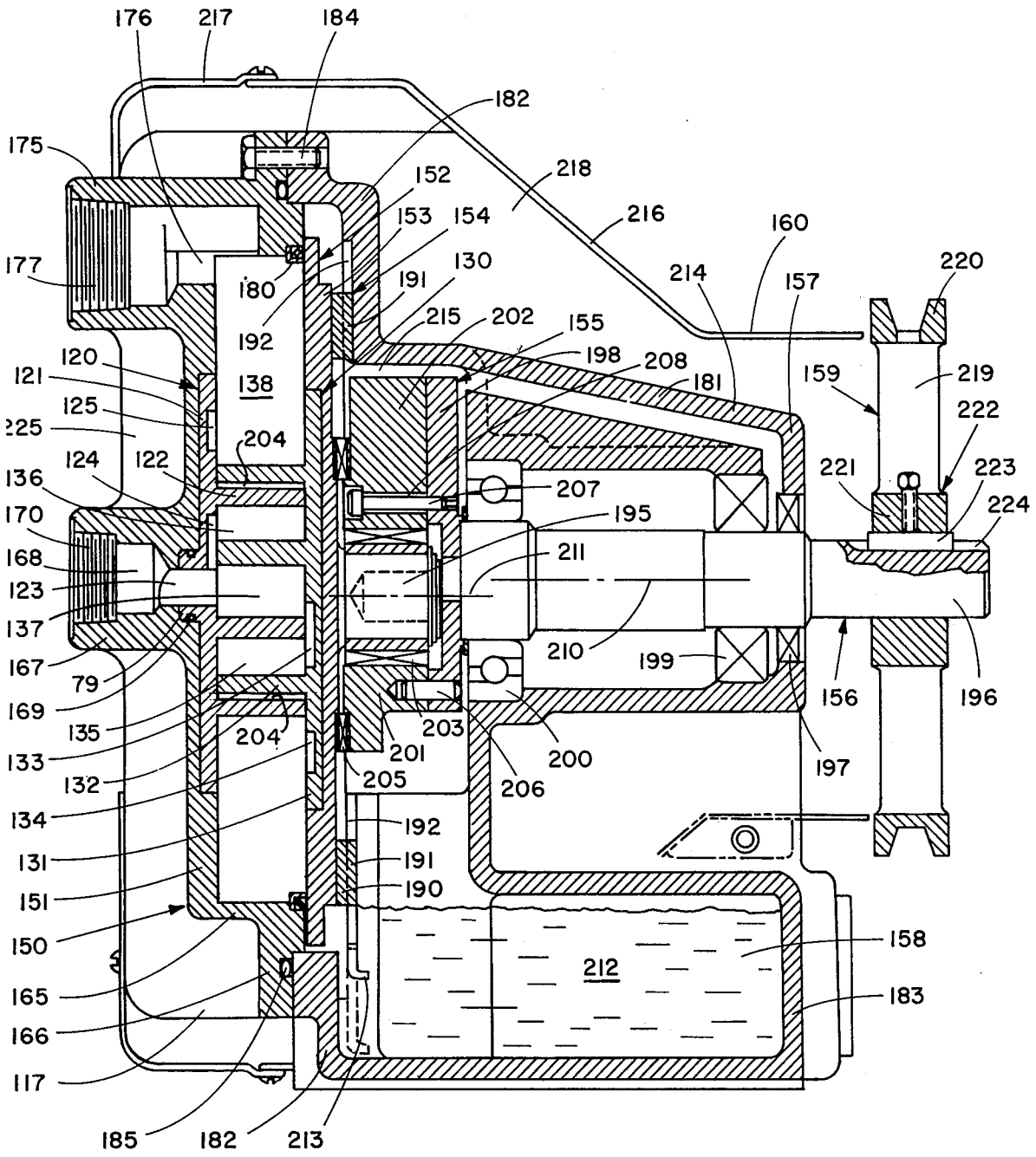
FIG. 61 is a longitudinal cross section of a scroll liquid pump constructed in accordance with this invention.

End plate 11 has a central boss 20 extending from outer surface 21. This boss 20 has an annular groove 22 arranged to hold a sealing ring when the stationary scroll element is assembled in a stationary scroll member in a liquid pump as shown in FIG. 61. A liquid port 23 extends through end plate 11 and boss 20 and a recessed transfer passage 24 is cut in surface 13 to provide liquid communication with port 23. Together port 23 and recessed transfer passage 24 form a manifold means or discharge zone. As shown in the top plan view of FIG. 1, transfer passage 24 has one principal boundary 25 coinciding with a line which passes through the center 26 of end plate 11 and is parallel to lines of contact 14 and 15 and another principal curved boundary 27 which conforms in configuration to the outer surface 34 of the involute wrap 32 of the orbiting scroll element 30 (FIGS. 3 and 4) when the two scroll elements are oriented such that the maximum of four contact points between the flanks of the wraps is achieved as shown in the orientation of the wraps in FIG. 5. Thus curved boundary 27 may be defined as a partial tracing of an involute wrap edge of the mating scroll elements. These principal boundaries are joined through blending radii 28. Although transfer passage 24 may be semicircular rather than having an involute boundary 27, the involute configuration illustrated is preferred for more accurate porting. Inasmuch as recessed transfer passage 24 is located within the involute wrap, it may, for convenience, be termed an "inner passage."

Although port 23 is shown in FIGS. 1 and 2 in a position to intersect boundary 25 of transfer passage 24, it is also within the scope of this invention to position port 23 anywhere within the innermost pocket formed by the wraps of the scroll elements, so long as port 23 is in communication with transfer passage 24 and does not interfere with the integrity of wrap 12.

Figure 3:
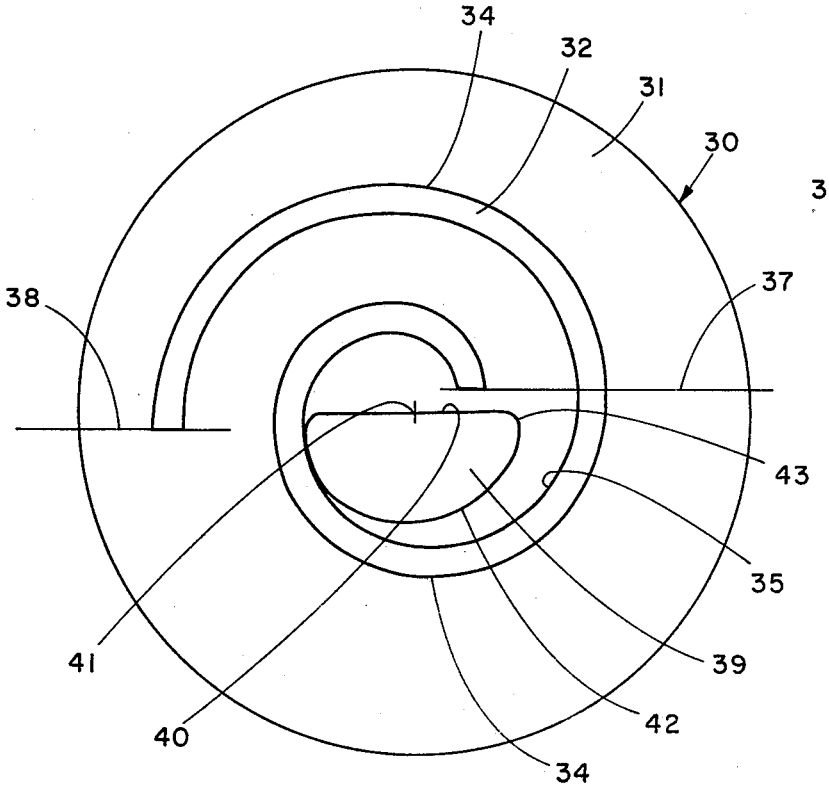
FIGS. 3 and 4 are top plan and cross sectional views of an orbiting scroll element for use with the stationary scroll element of FIGS. 1 and 2.
Figure 4:
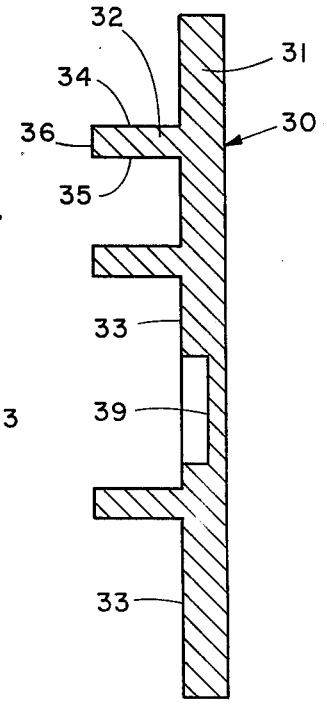
Figure 5:
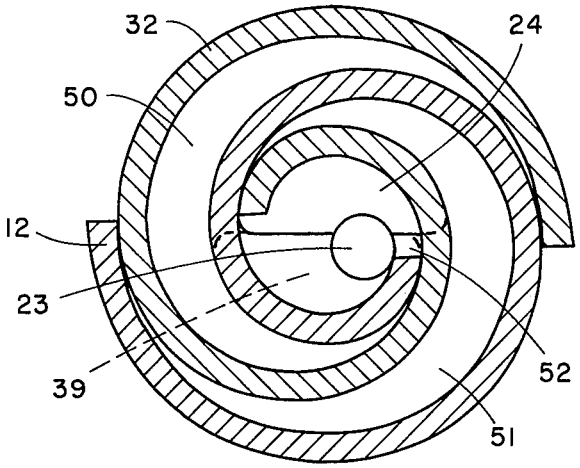
FIGS. 5–20 are alternating transverse and longitudinal cross sections of the stationary and orbiting scroll elements of the embodiment of FIGS. 1–4 illustrating the operation of the centrally located discharge porting of that embodiment.

As will be seen in FIGS. 3 and 4, the orbiting scroll element 30 has a configuration similar to that of the stationary scroll element 10. The orbiting scroll element 30 is formed of an end plate 31 and an involute wrap 32 affixed to or integral with the inner surface 33 of end plate 31. Wrap 32 has an outer contacting flank surface 34, and inner flank surface 35 and an end contacting surface 36. Involute wrap 32 begins at a line of contact 37 which is drawn as a tangent to the involute generating radius and through the points of contact between the involutes of the stationary and orbiting scroll elements, and it ends at a line of contact 38 which is also drawn as a tangent to the involute generating radius. A recessed transfer passage 39 is cut into the surface 33 of the end plate of the orbiting scroll element, its location and configuration bearing the same relationship to the stationary scroll element as transfer passage 24 of the stationary element bears to the orbiting scroll element. That is, transfer passage 39 is defined by one principal straight-line boundary 40 coinciding with a line drawn through end plate center 41 and parallel to lines of contact 37 and 38 and another principal curved boundary 42 corresponding to a partial tracing of outer surface edge 16 of wrap 12 of the stationary scroll element when the scroll elements are oriented to achieve the maximum of four points of contact as shown in FIG. 5. These principal boundaries are likewise joined through blending radii 43. In combination these recessed transfer passages 24 and 39 in the end plates of the scroll elements comprise one embodiment of the unique porting system of the apparatus of this invention.

If the scroll elements are manufactured from a metal such as stainless steel, the recessed transfer passages may be formed by machining them out; and if they are formed of a synthetic resin such as a polyimide, the recessed transfer passages may be formed during the molding of the elements. In general, it will be preferable to form these recessed passages to have a depth approximately equal to the width of the involute wrap.

The manner by which the porting system of the scroll elements of FIGS. 1–4 achieves essentially pulsation-free liquid pumping may be detailed with reference to FIGS. 5–20 which illustrate the operation of a scroll pump using these scroll members and pumping a liquid flowing radially inward. FIGS. 5–20 illustrate various positions at one-eighth orbit intervals of the scroll elements during one pumping cycle, the odd-numbered figures being cross sections of the wraps taken transverse to the center line of the apparatus and the even-numbered figures following them being the corresponding longitudinal cross sections through the wraps. Like reference numerals in FIGS. 5–20 are used to refer to like components of FIGS. 1–4. Although it would not be normal to see the outline of the recessed transfer passage 39 of the orbiting scroll element in those cross sectional drawings taken transverse to the center line (e.g., FIGS. 5, 7, etc.) these outlines have been dotted in to provide the location of the transverse passages in the accompanying longitudinal cross sections (e.g., FIGS. 6, 8, etc.). Boss 20 of the stationary scroll element has been eliminated in the longitudinal cross sections of FIGS. 6, 8, etc. for the sake of simplicity.

In the operation of the scroll pump, the orbiting scroll element 30, mounted in an orbiting scroll member, is driven to orbit (by means described in detail with reference to FIG. 61) the stationary scroll element 10 mounted in a stationary scroll member, the flank surfaces 16 and 17 and 34 and 35 of the stationary and orbiting scroll elements making moving line contacts. As will be described in connection with the description of FIG. 61, there can, in actual practice, be a very small clearance, e.g., from about 0.001 to about 0.005 inch, between the flank surfaces of the involutes. The end surfaces 18 and 36 of the stationary and orbiting scroll elements in making contact with the inner surfaces 33 and 13 of the orbiting and stationary scroll elements, respectively, define the moving pockets 50, 51 and 52, the volumes of which and liquid communication between which change to effect the movement of the liquid through the pump. Because liquids have much higher viscosities than gases and because the volume ratio within the liquid pump is one rather than greater than one, the need for efficient radial sealing across the contacting end surfaces 18 and 36 of the wraps from pocket to pocket is not as stringent as for compressors or expanders. It is therefore unnecessary to provide radial sealing means such as those described in U.S. Pat. No. 3,944,636.

Figure 6:
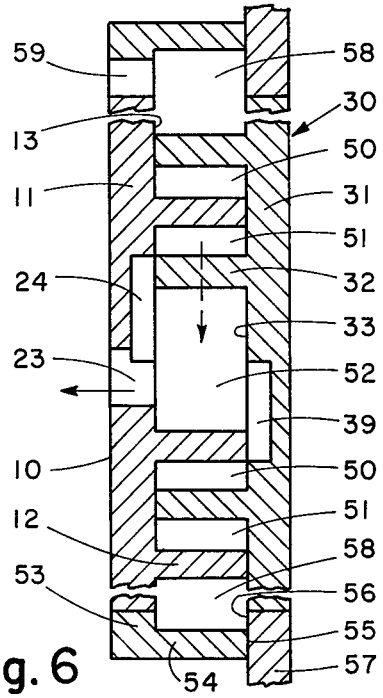
Figure 7:
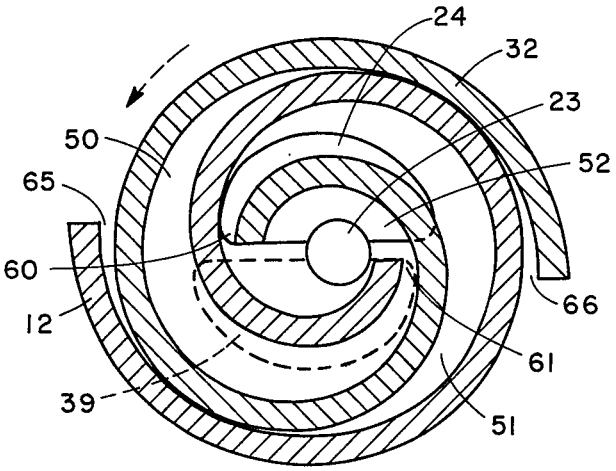

The somewhat simplified longitudinal cross section of FIG. 6 shows the stationary scroll element 10 mounted in a scroll member which includes a housing plate 53 having an annular extension 54, the end surface 55 of which serves as a contacting surface with which the inner surface 56 of the orbiting scroll member 57, of which orbiting scroll end plate 31 is a part, makes moving contact to define a preipheral volume 58 into which the liquid to be pumped is introduced through peripheral port 59. FIG. 61 illustrates the incorporation of the scroll members in a complete scroll pump in more precise detail. In the remaining even-numbered FIGS. 8, 10 . . . 20, only those portions of the scroll elements including the wraps and porting will be illustrated, it being understood that each has a peripheral volume.

It is assumed that the cycle to be described begins with the sealing off of center pocket 52 at which point pockets 50 and 51 are also sealed off. Liquid is discharged through the discharge manifold means comprising port 23 and transfer passage 24. In this mode of operation central pocket 52 serves as a discharge zone. As shown in FIGS. 5 and 6, pockets 50 and 51 are at their maximum volumes and essentially completely sealed off from central pocket 52, discounting any small clearances between wrap flanks and between wrap end surfaces and end plates. Assume first that neither of the recessed transfer passages 24 nor 39 is cut in the end plates. The effect of this may be seen in FIGS. 7 and 8 which show the wrap positions after the completion of one-eighth of a total orbit of the orbiting scroll member, the orbit direction of which is shown by the dotted arrow. The volumes of pockets 50, 51 and 52 begin to decrease; and, since the liquid in the pump is essentially noncompressible, it is forced under pressure from pockets 50 and 51 into center pocket 52 through the relative narrow passages 60 and 61 created by wrap movement. Moreover, the comparative sizes of central pocket 52 and discharge port 23 are such as to accentuate this effect. The result is the building up of pressures within the system which have a serious adverse affect upon the scroll hardware and the generation of severe pressure pulses giving rise to inefficient and noisy operation.

The presence of inner recessed transfer passages 24 and 39 in the fixed and orbiting scroll members, respectively, essentially eliminates this undesirable situation. As will be seen from FIG. 8, these transfer passages are so contoured and located as to open essentially instantaneously after the closing of pocket 52. Thus these transfer passages 24 and 39 which were previously blocked off by virtue of the position of the wrap, are opened with the continued movement of the orbiting wrap. Transfer passages 24 and 39 are of a size and depth to augment passages 60 and 61 to the extent that there is sufficient flow capacity to prevent the buildup of pressure within the pockets and to permit nonpulsating flow of the liquid through port 23. (In the drawings the flow of liquid is indicated by the solid arrows.)

As will be seen in FIGS. 9–14, transfer passages 24 and 39 remain open to permit essentially nonpulsating liquid flow from pockets 50 and 51 into 52; and then, as pockets 50, 51 and 52 decrease in volume and become virtually one central pocket, these passages continue to permit the smooth discharge through the discharge port 23. As the combined volume of pockets 50, 51 and 52 decreases, liquid from peripheral volume 58 begins to enter into what may be termed "open" pockets 65 and 66 defined between the scroll wraps. These pockets 65 and 66 are open in the sense that they are in direct communication with peripheral volume 58. As will be seen in FIGS. 9 and 10, as the orbiting progresses through its first quarter, the passages 60 and 61 formed by wrap movement grows larger and transfer passages 24 and 39 are full open allowing free flow of liquid into center pocket 52 and through the discharge manifold menas. Passages 60 and 61 continue to be enlarged until one-half orbit is completed as seen in FIGS. 11–14. Although transfer passages 24 and 39 continue to provide communication among pockets 50, 51, 52, they no longer are required to conduct an appreciable amount of liquid and they are gradually closed by the movement of the orbiting scroll member. As will be seen in FIGS. 15–20, the situation obtains until the center pocket 52 can be considered to be a separate pocket at completion of about three-quarters of the orbit) and the "open" pockets 65 and 66 are sufficiently closed off from peripheral volume 58 to be considered to have formed new outer pockets 50 and 51, open to the peripheral volume from ever decreasing passages 67 and 68.

With the closing of passages 67 and 68 all of the closed pockets including central pocket 52 reach maximum liquid volume to set up the situation depicted in FIGS. 5 and 6 and begin the cycle anew. So long as passages 67 and 68 are open to the peripheral volume, the transfer passages 24 and 39 are closed; but, as noted above, essentially instantaneously with the closing of the three pockets, the porting system of this invention becomes operative.

Figure 21:
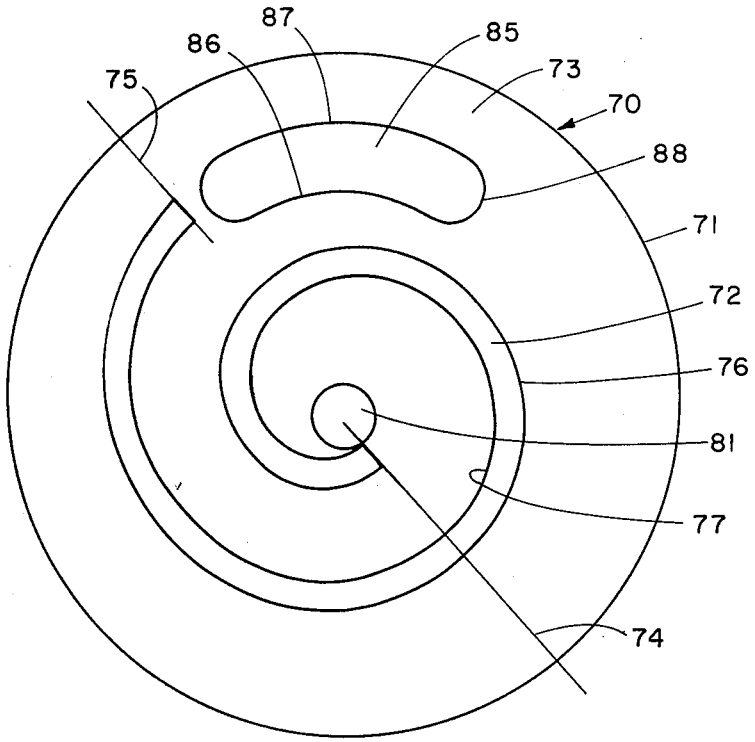

FIGS. 21–24 illustrate stationary and orbiting scroll elements incorporating the porting system of this invention and suitable for incorporation into a scroll pump in which liquid flow is from the central pocket radially outward to the peripheral volume. The fixed scroll element 70 of FIG. 21 is comprised of an end plate 71 and an involute wrap 72 integral with or affixed to inner surface 73. Wrap 72, like wrap 12 of FIGS. 1 and 2, begins at a line of contact 74 and ends at a line of contact 75 and constitutes an involute of one and one-half turns. Wrap 72 has an outer flank surface 76, an inner flank surface 77 and an end surface 78. End plate 71 has a central boss 79 on outer surface 80. A liquid port 81 extends through end plate 71 and boss 79.

A recessed transfer passage 85 is cut in inner surface 73 of end plate 71. As shown in the top plan view of FIG. 21, transfer passage 85 has a principal inner boundary 86 conforming in configuration to the inner surface 95 of the involute wrap 92 of the orbiting scroll member 90 (FIGS. 23 and 24) when the two scroll members are oriented such that the maximum of four contact points between the flanks of the wraps is achieved as shown in FIG. 25. Thus this principle boundary 86, like boundary 27 of inner passage 24 of FIG. 1, represents a partial tracing of an involute wrap edge of the mating scroll element. The second principal or outer boundary 87 of transfer passage 85 is cut to follow the contour of inner boundary 86 and is spaced radially outward therefrom. Boundaries 86 and 87 are joined through blending radii 88. The distance between boundaries 86 and 87 is preferably about twice the thickness of the involute wrap of the scroll element. Transfer passage 85 is thus an arcuate recess contiguous with or spaced a short distance from the outer end of wrap 72 and extending through an arc ranging between about 45 and 90°. Since transfer passage 85 is located outside the involute wrap it may, for convenience, be referred to as an "outer" passage.

Figure 23:
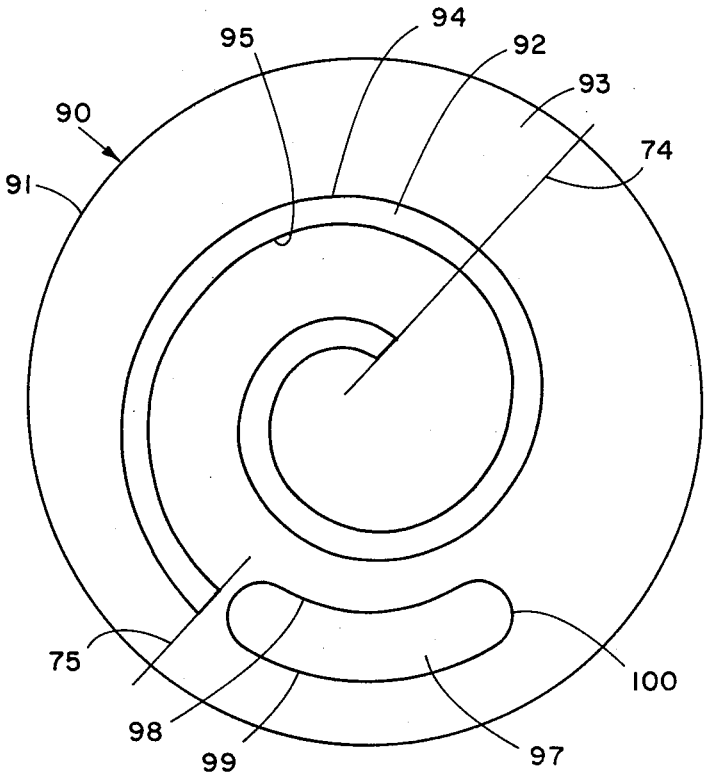
FIGS. 23 and 24 are top plan and cross sectional views of an orbiting scroll element for use with the stationary scroll element of FIGS. 21 and 22.
Figure 24:
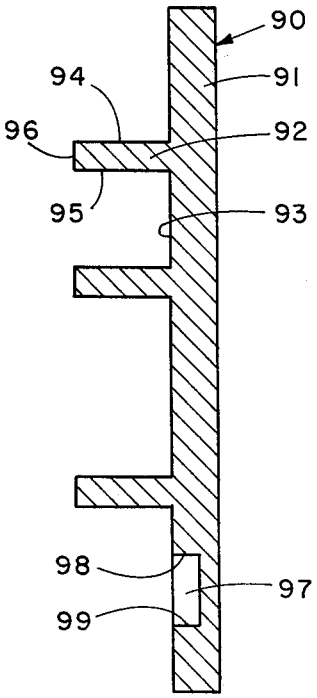
Figure 25:
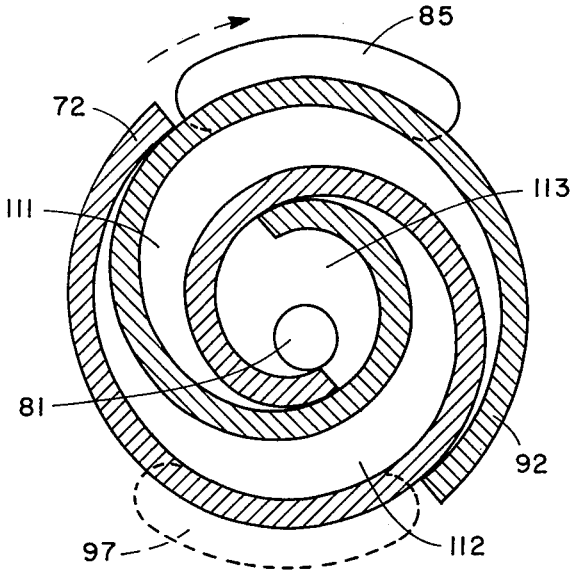
FIGS. 25–40 are alternating transverse and longitudinal cross sections of the stationary and orbiting scroll elements of the embodiment of FIGS. 21–24 illustrating the operation of the peripherally located discharge porting of that embodiment.

The orbiting scroll element 90, shown in top plan and cross sectional views in FIGS. 23 and 24, is formed of an end plate 91 and an involute wrap 92 integral with or affixed to inner surface 93. Wrap 92 begins at line of contact 74 and ends at line of contact 75, being formed as one and one-half turns of the involute. Wrap 92 has an outer contacting flank surface 94, an inner flank surface 95 and an end contacting surface 96. A recessed transfer passage 97, corresponding to transfer passage 85 of the stationary scroll element, is cut in inner surface 93 of end plate 91. As shown in the top plan view of FIG. 23, transfer passage 97 has a principal inner boundary 98 conforming in configuration to a partial tracing of the inner surface edge 77 of involute wrap 71 of the stationary scroll element 70 when the two scroll elements are oriented such that the maximum of four contact points between the flanks of the wraps is achieved. The principal outer boundary 99 of transfer passage 97 has the same contour as the principal inner boundary 98 and the passage is closed by blending radii 100. It is configured and sized to correspond to the arcuate recessed transfer passage 85 of the stationary scroll member.

The manner in which the porting system of the scroll elements of FIGS. 21–24 achieve essentially pulsation-free liquid pumping may be detailed with reference to FIGS. 25–40 in which the scroll elements are shown pumping a liquid radially outward. As in the case of FIGS. 5–20, FIGS. 25–40 illustrate various positions of the scroll elements during one pumping cycle, the odd-numbered figures being cross sections of the wraps taken transverse to the center line of the apparatus and the even-numbered figures following them being the corresponding longitudinal cross sections through the wraps. In FIGS. 25–40 the longitudinal plane through the scroll members is rotated about the center line from figure-to-figure to intersect the recessed transfer passages 85 and 97 to best illustrate their opening and closing.

Figure 26:
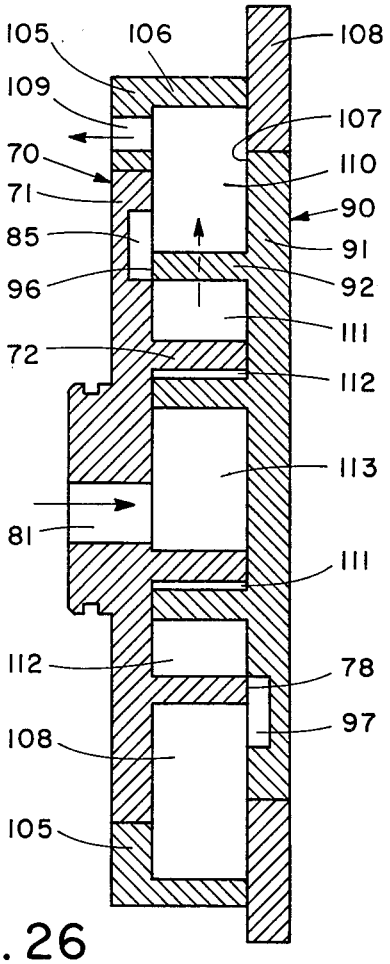
Figure 27:
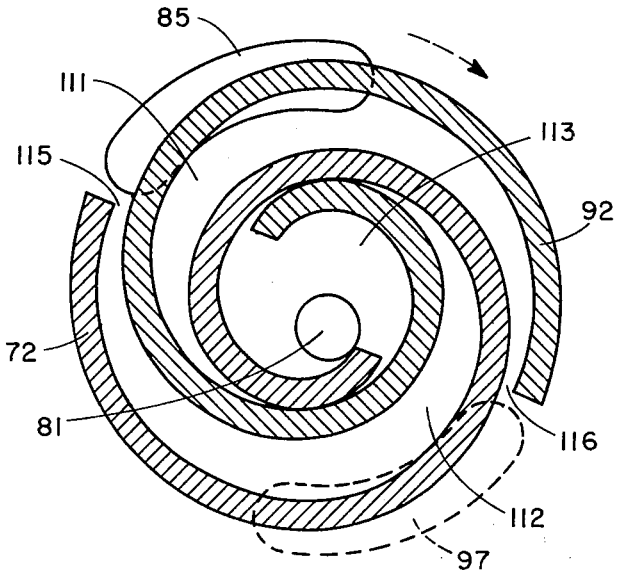
Figure 28:
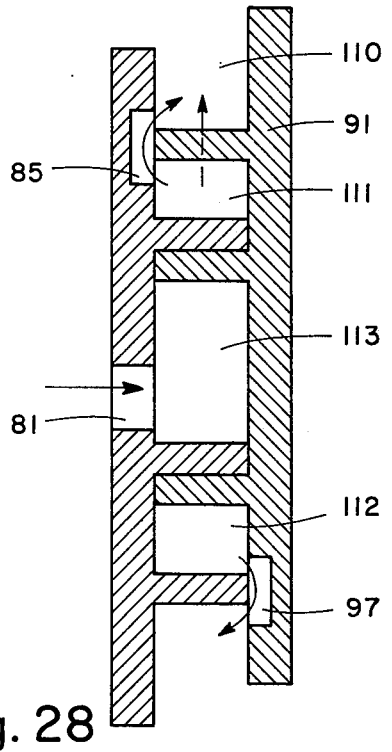
Figure 29:
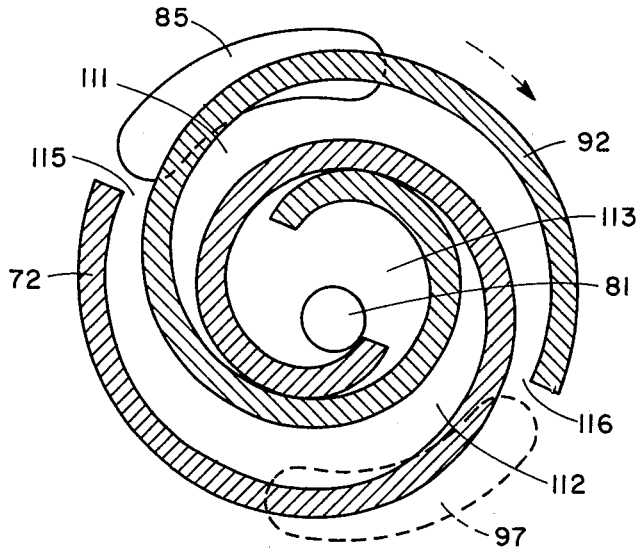
Figure 30:
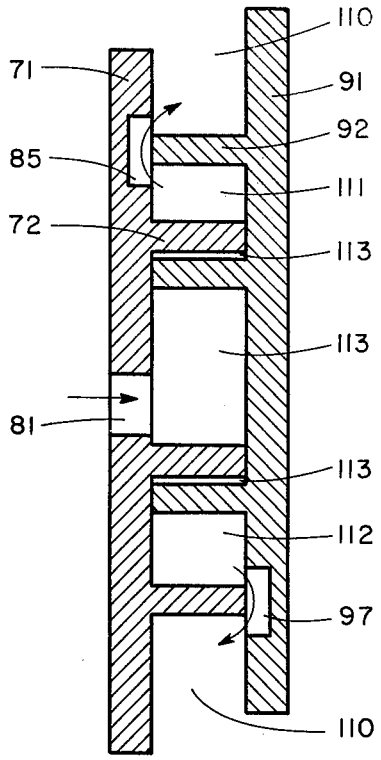
Figure 31:
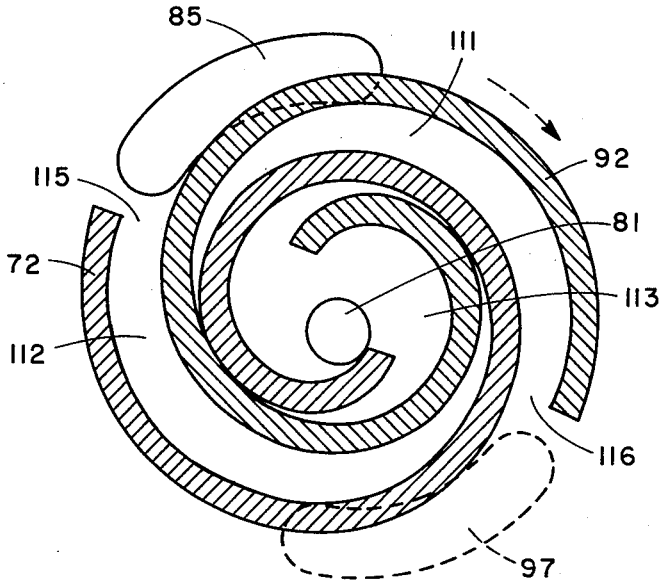
Figure 32:
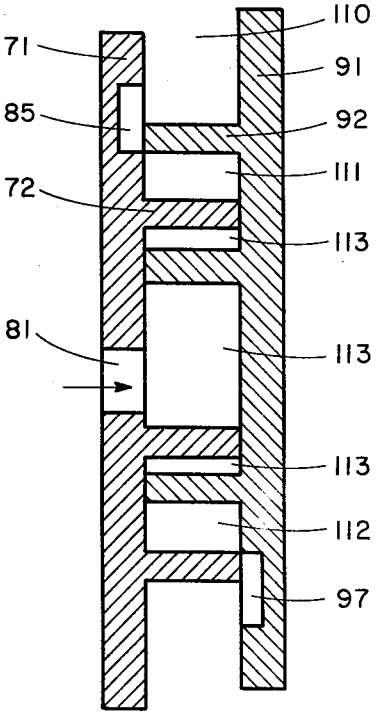
Figure 33:
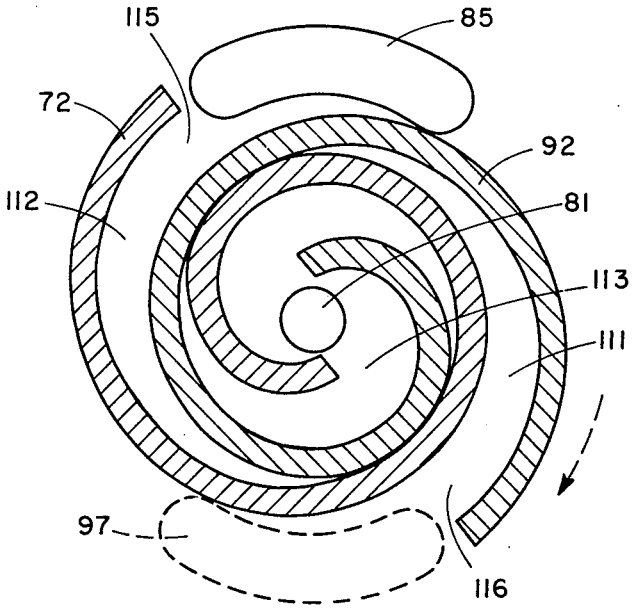
Figure 34:
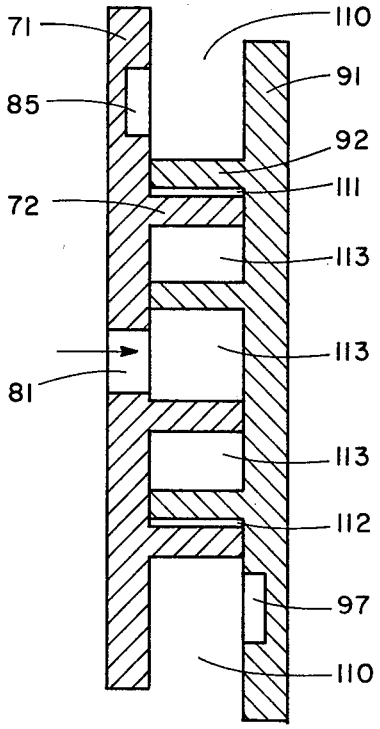

Scroll elements 70 and 90 are shown in FIG. 26 to be incorporated in a scroll pump in the same manner as shown in FIG. 6. Thus the stationary scroll element 70 is mounted in a housing plate 105 which has an annular extension member 106 providing a contacting surface 107 for the inner surface 93 of orbiting scroll member extension 108. A peripheral liquid volume 110 is defined within the enclosed volume thus created and a port 109 (of which there may be more than one) is cut through housing plate 105 to provide liquid communication between peripheral volume 110 and a liquid reservoir, not shown. In the operation to be described, port 109 serves as the liquid discharge manifold for the peripheral discharge zone thus created, the liquid flow being radially outward. Port 81 in the fixed scroll member is therefore the inlet manifold. In the wrap positions illustrated in FIGS. 25 and 26 there are two closed outer pockets 111 and 112 and a central pocket 113.

The operation of the porting system of this invention is illustrated in detail in FIGS. 25–40. It will be assumed that the cycle begins with that point when each of the pockets 111, 112 and 113 has just been sealed off from the others and is at its minimum volume just prior to beginning to enlarge. As in the case of the porting system described above, in FIGS. 1–20, there can be a small clearance, e.g., from between about 0.001 and 0.005 inch between the wrap flanks at all times to avoid flank wear. Again, assuming first that there were no arcuate recessed transfer passages in end plates 71 and 91, it will be seen that the liquid in pockets 111 and 112 would be subjected to constantly increasing pressure as the orbiting scroll is driven in the direction indicated by the broken arrows in FIGS. 25 and 26. This is due to the fact that the openings 115 and 116 (FIG. 27), created by the movement of the orbiting scroll wrap 92 relative to the stationary scroll wrap 72 are not large enough to permit the flow of the liquid from pockets 111 and 112 into peripheral zone 110 at a rate to prevent excessive pressurization of the liquid in pockets 111 and 112. The result is the development of pressure pulsations and eventual damage to the scroll hardware.

When, however, recessed transfer passages 85 and 97 are present, there are provided, essentially instantaneously after the closing of pockets 111, 112 and 113, additional liquid flow passages. Thus transfer passages 85 and 97 augment passages 115 and 116 created by the movement of the orbiting scroll wrap relative to the stationary scroll wrap and eliminate undue pressurization of the liquid which in turn gives rise to pressure pulsations.

As will be seen from FIGS. 27–32, the transfer passages 85 and 97 are closed by the time the orbiting scroll member has completed three-eighths of its orbit, for by this time they are no longer needed to augment liquid passages 115 and 116 which have reached near maximum. Central pocket 113, of course, encompasses more and more of the volume previously part of pockets 111 and 112, a fact that effects sufficient control of the liquid pressure within central pocket 113 as additional liquid is taken in. It will be appreciated from the drawings that as the cycle proceeds, the pockets as numbered and designated in FIGS. 25 and 26 become less and less sharply defined, a portion of each of pockets 111 and 112 becoming indistinguishable from central pocket 113. However, for clarity, the reference numerals of FIGS. 25 and 26 are used throughout FIGS. 27–40 and the description of these drawings.

Figure 35:
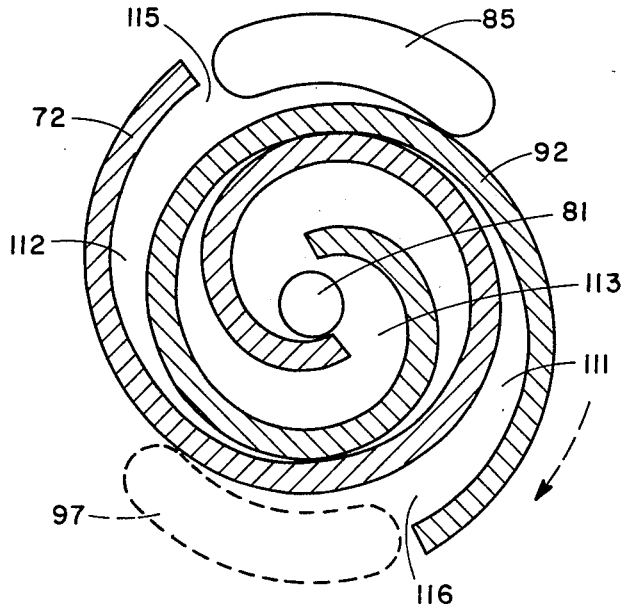
Figure 36:
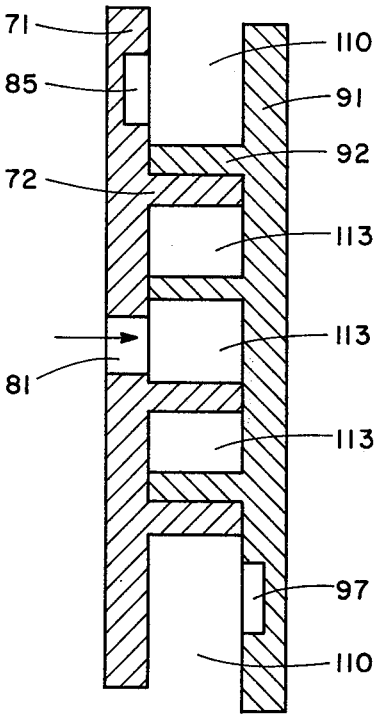
Figure 37:
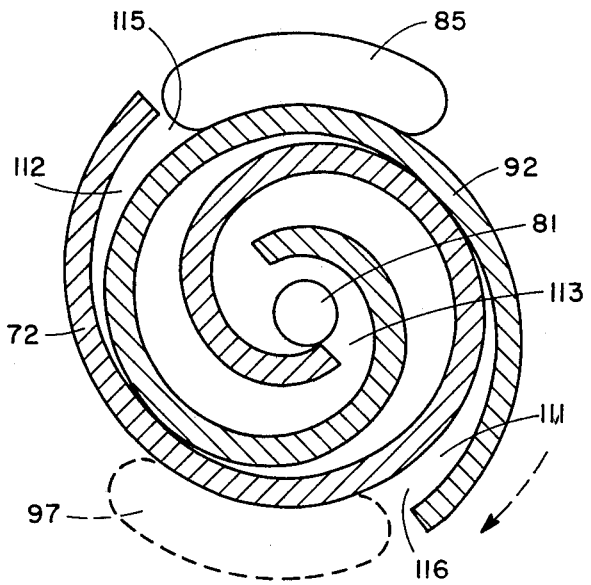
Figure 38:
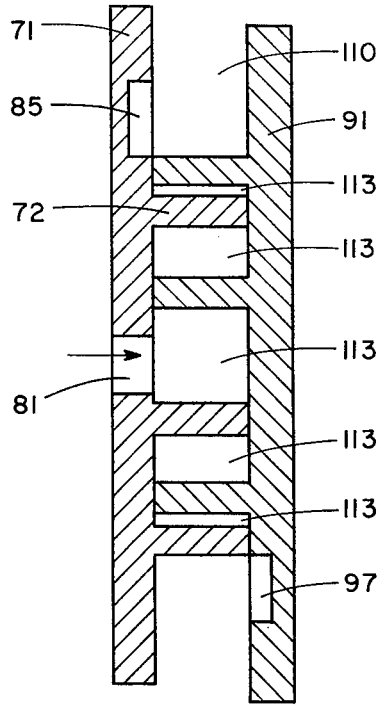
Figure 39:
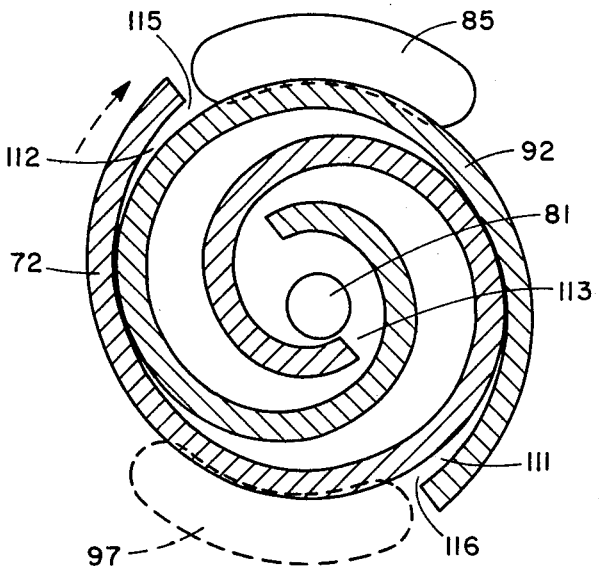
Figure 40:
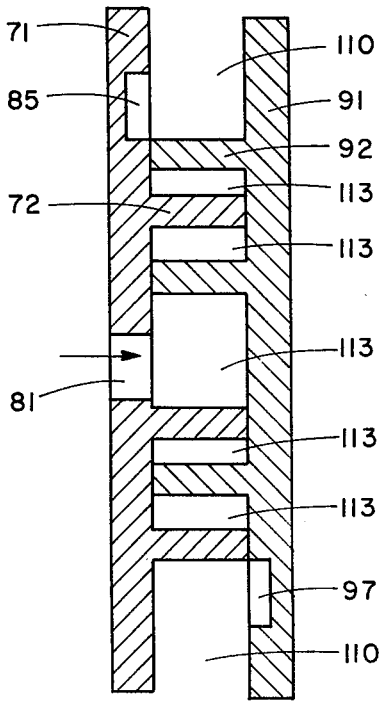
Figure 42:
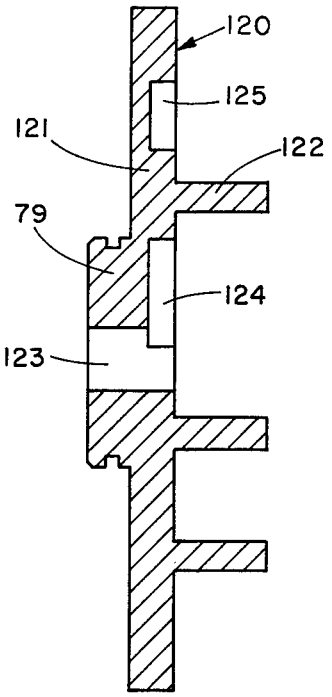
FIGS. 41 and 42 are top plan and cross sectional views of yet another embodiment of a stationary scroll element constructed in accordance with this invention incorporating both central and peripheral discharge porting and in which the liquid flow may be either inwardly or outwardly directed.
Figure 41:
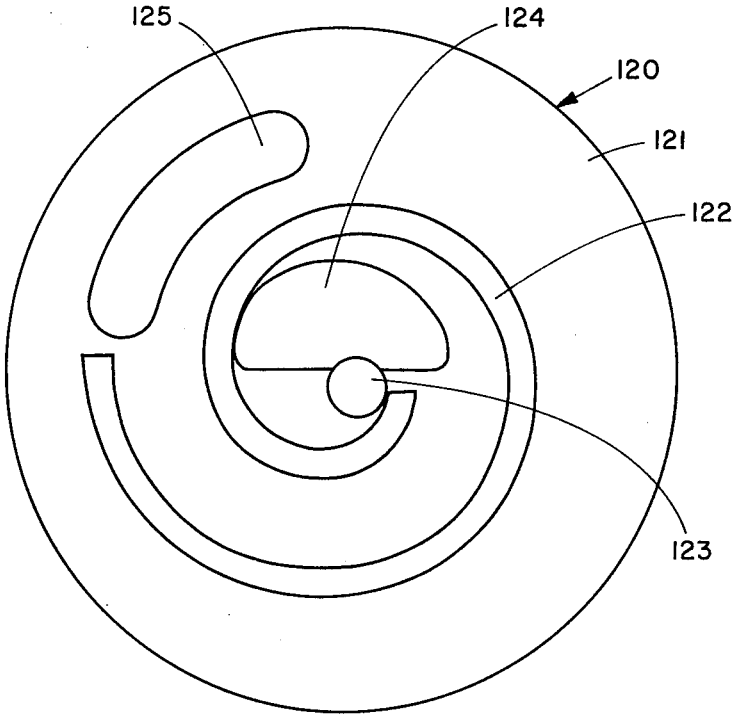
Figure 43:
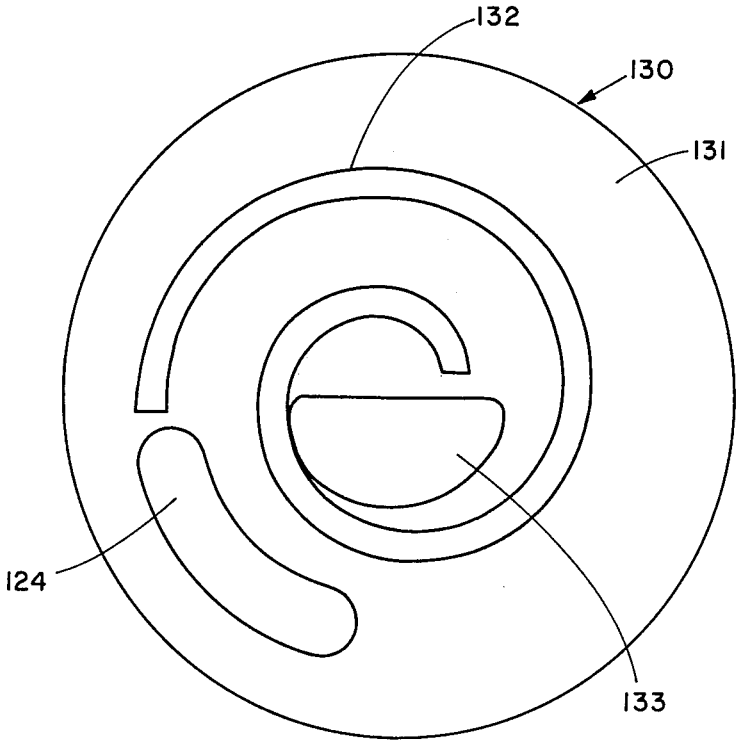
FIGS. 43 and 44 are top plan and cross sectional views of an orbiting scroll element for use with the stationary scroll element of FIGS. 41 and 42.
Figure 44:
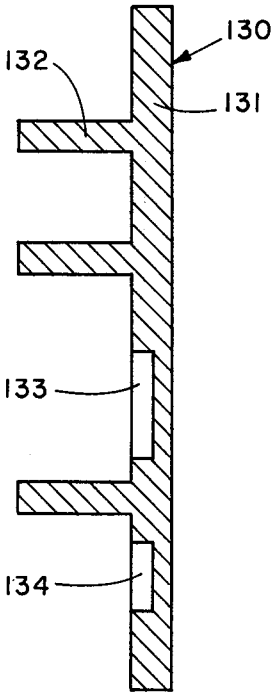

Passages 115 and 116 between the wraps 72 and 92 remain at their essentially maximum dimension as the pumping continues through three-fourths of the cycle as shown in FIGS. 35 and 36. This permits transfer passages 85 and 97 to remain effectively closed, i.e., inoperative. Finally, through the last quarter of the cycle (FIGS. 37–40) the small volume of liquid remaining in pockets 111 and 112 is transferred to peripheral volume 110; and at the end of the cycle passages 115 and 116 are closed. As will be apparent from FIGS. 33–40, the transfer passages 85 and 97 remain closed since the porting achieved by the movement of the orbiting wrap relative to the fixed wrap is adequate to obtain pulsation-free liquid flow and discharge. With the completion of the cycle, the pockets 111, 112 and 113 are sealed off as shown in FIG. 25 to be in position to begin another cycle.

From the above description of the working of the liquid porting system of this invention it will be seen that the recessed liquid transfer passage means are located and configured to be opened substantially immediately after the orbiting involute wrap has reached that point in its orbiting cycle to define three essentially completely sealed-off liquid pockets and to remain open at least until the liquid passages defined by the movement of the orbiting wrap and providing liquid communication into the liquid discharge zone (whether central or peripheral) are sufficiently large to prevent any substantial pressure pulsation within the scroll pump.

For many applications, liquid scroll pumps designed to operate with radially outward flow are preferable over those designed for inward flow. In the outward flow pumps the hydraulic pressures within the pump can be used to hold the scroll members together, thus generally achieving a more efficient operation. Moreover, it is possible to have a larger discharge porting means, using multiple ports spaced around the peripheral zone if desired. These factors contribute to even more effective reduction or elimination of flow pulsations with the use of the porting system of this invention.

It is also within the scope of this invention to incorporate both central (inner) and peripheral (outer) recessed transfer passages in the end plates of the scroll elements as illustrated in FIGS. 41–44. The stationary scroll element 120 of FIGS. 41 and 42 has an end plate 121 and wrap 122 of one and one-half involute turns as in the case of the scroll elements of FIGS. 1 and 2 or FIGS. 21 and 22. Scroll element 120 has a central port 123, a centrally located recessed transfer passage 124 of the same configuration as passage 24 of FIG. 1 and a peripherally located recessed transfer passage 125 of the same configuration as passage 85 of FIG. 21. In like manner, the orbiting scroll element 130 of FIGS. 43 and 44 has an end plate 131 and wrap 132 of one and one-half involute turns as in the case of the scroll elements of FIGS. 3 and 4 or FIGS. 23 and 24. Scroll element 130 has a centrally located transfer passage 133 and a peripherally located recessed transfer passage 134 of the same size and configuration as shown in FIGS. 3 and 23, respectively.

FIGS. 45–60 are the same type of cross sectional drawings as FIGS. 25–40, the longitudinal planes along which the even numbered FIGS., e.g., 46, 48, etc., are taken being rotated in order to show clearly which transfer passages are open. A liquid scroll pump incorporating the scroll elements of FIGS. 41–44 can be used to pump liquid radially inward from the peripheral volume through a central discharge zone or radially outward from the central pocket through a peripheral discharge zone. In FIGS. 45–60 the sequence of steps shown illustrates the first of these modes of operation, i.e., radially inward. However, FIGS. 45–60, taken in a different sequence can also be used to illustrate the operation of the porting system when pumping in the second or radially outward operating mode as will be described. Therefore, in order to use FIGS. 45–60 to illustrate both of these operational modes, the flow of liquid in the first inward flow mode will be indicated by an arrow labelled with an encircled numeral 1 followed by a, b . . . h, each letter indicating the ordered sequence of the pumping cycle by increments of one-eighth orbit as shown in the previous drawings. The second outward flow mode will be indicated by an arrow labelled with an encircled numeral 2 followed by a, b . . . h, also used to indicate the sequence of the pumping cycle. In this latter case, the figures must be examined out of their numbered order as will be described.

Figure 45:
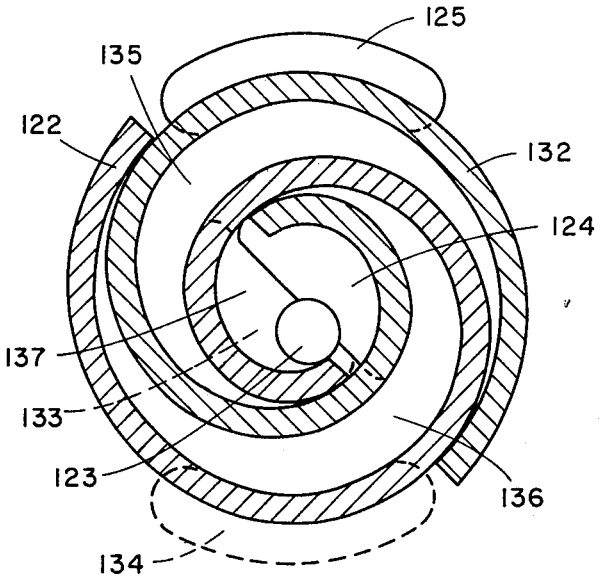
FIGS. 45–60 are alternating transverse and longitudinal cross sections of the stationary and orbiting scroll elements of the embodiment of FIGS. 41–44 illustrating the operation of the discharge porting of that embodiment when the liquid flow is inwardly or outwardly directed.
Figure 46:
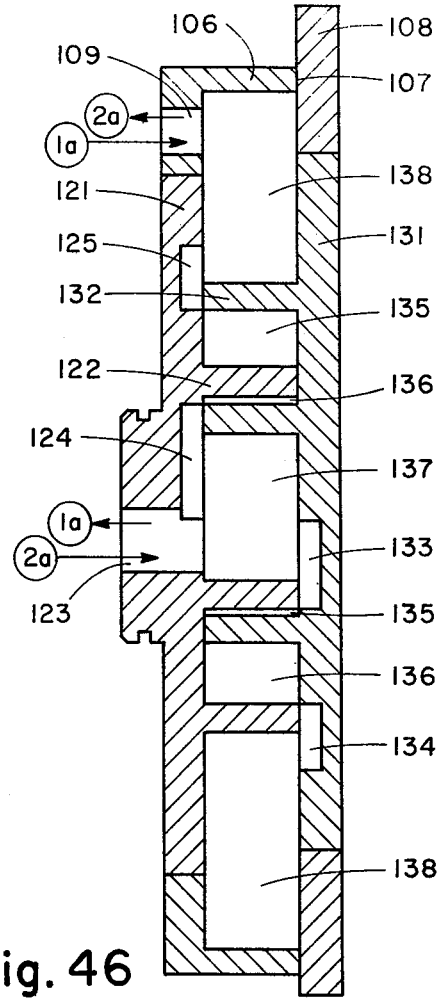

The scroll members of FIGS. 41–44 are shown in FIG. 46 to be set in a liquid pump in the same manner as described for FIG. 26 and the same reference numerals are used to identify the same elements. As will be seen in FIG. 45, the cycle may be assumed to begin with outer liquid pockets 135 and 136 and central pocket 137 having just been closed. The following description pertains to the first mode of operation; namely, radially inward liquid flow.

It will be seen from FIGS. 45–56, and a comparison of these drawings with FIGS. 5–16, that the porting systems of this invention in which there are both central and peripheral recessed transfer passages (124, 133, 125 and 134) operates in the same manner as the porting system in which there is only the central transfer passages. That is, in a fluid pump having the stationary and orbiting scroll elements of FIGS. 41–44 and operating to pump the liquid radially inward, the central transfer passages 124 and 133 serve to augment the center passages 140 and 141 created by the wrap movement to achieve rapid and pulse-free liquid flow through discharge port 123. The peripheral transfer passages are not required and remain inoperative during the first five-eighths of the pumping cycle, since the peripheral passages 142 and 143 created by wrap movement are adequate to admit liquid into the scrolls. However, during the time the orbiting scroll member moves between five-eighths and three-quarters of its orbit (see FIGS. 55–58) the orbiting scroll wrap has moved to open the peripheral transfer passages 125 and 134 to augment the flow of liquid through peripheral passages into the open pockets 144 and 145 which are the precursors for and which develop into pockets 135 and 136. The movement of additional liquid into pockets 144 and 145 results in the attainment of smoother liquid flow into and hence more uniform liquid flow through the scrolls. As will be seen from FIGS. 57–60, these peripheral transfer passages 124 and 134 remain open and operative until the end of the cycle at which time pockets 135 and 136 are closed off (FIGS. 45 and 46).

Figure 47:
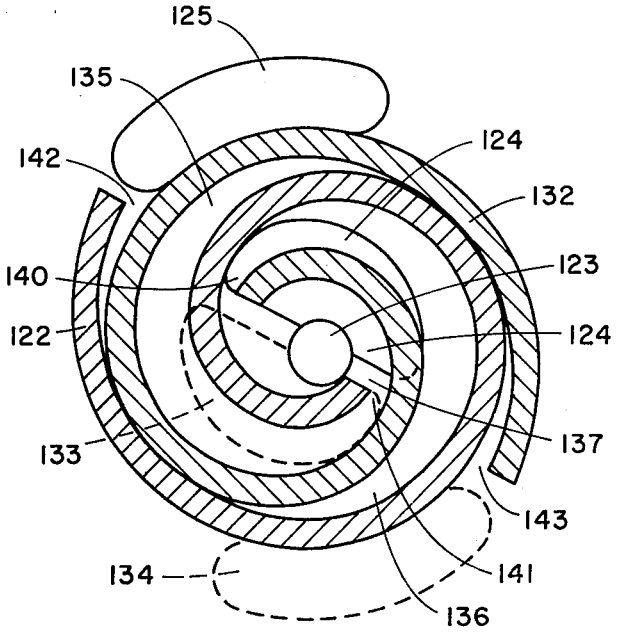
Figure 48:
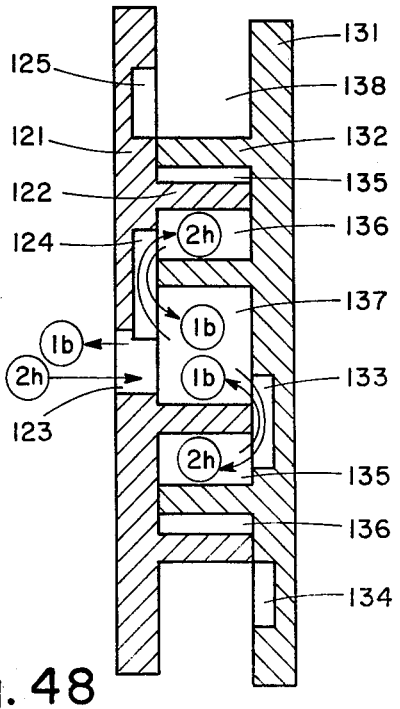
Figure 49:
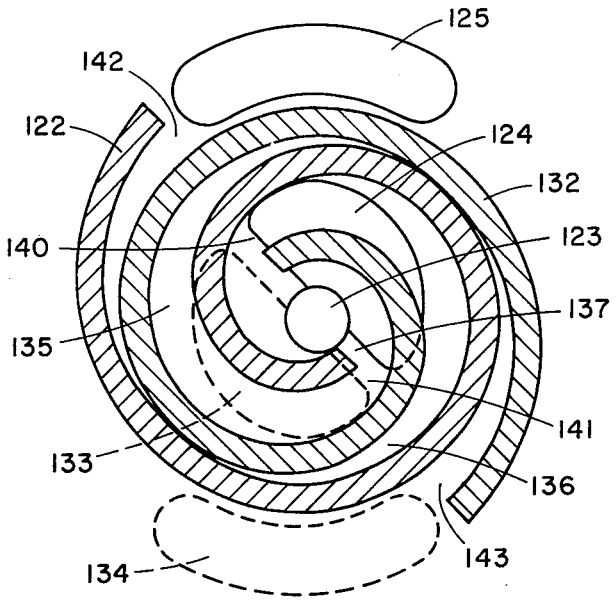
Figure 50:
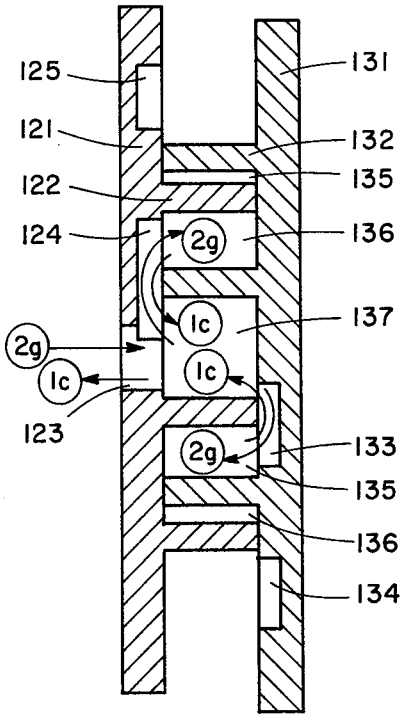
Figure 51:
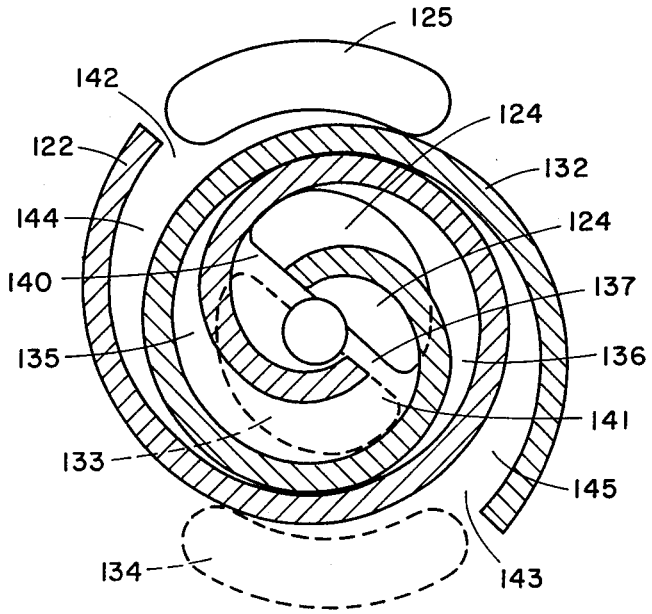
Figure 52:
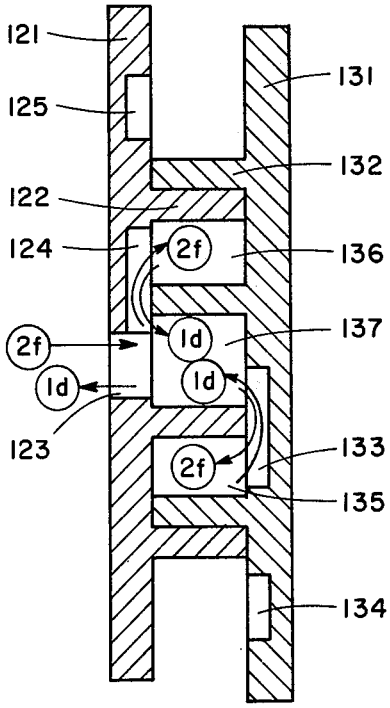
Figure 53:
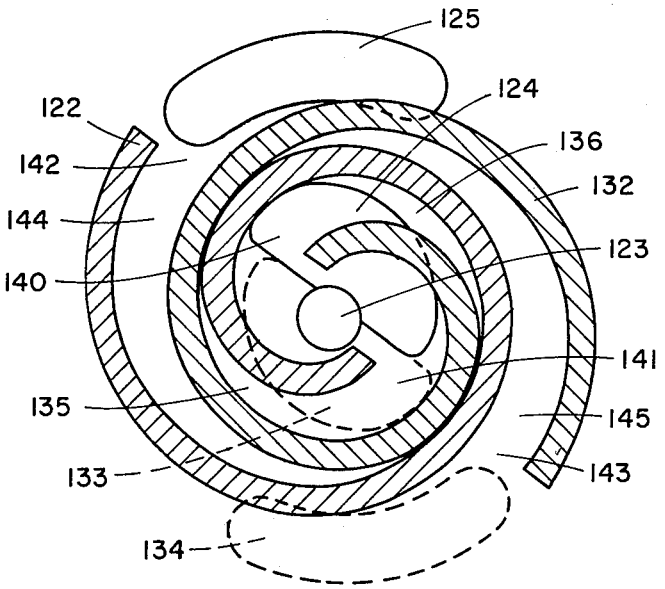
Figure 54:
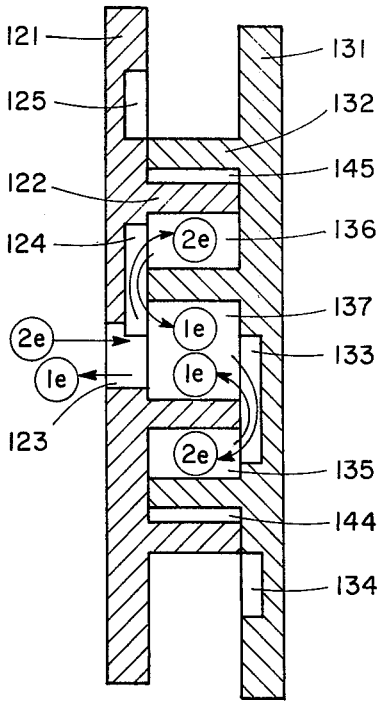
Figure 55:
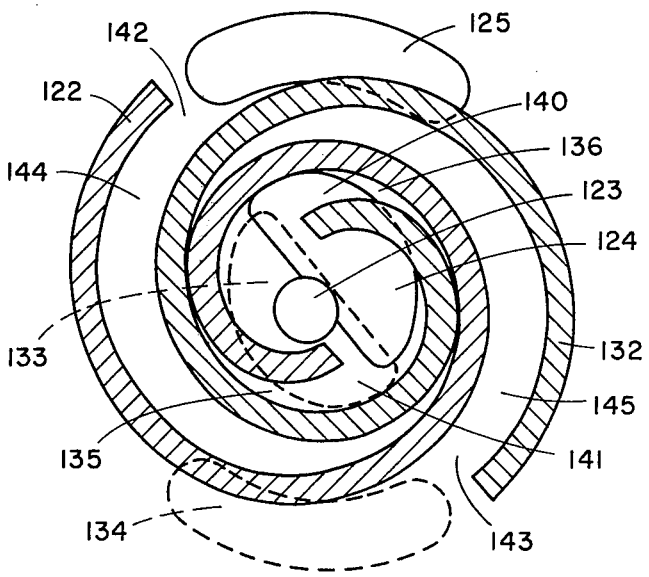
Figure 56:
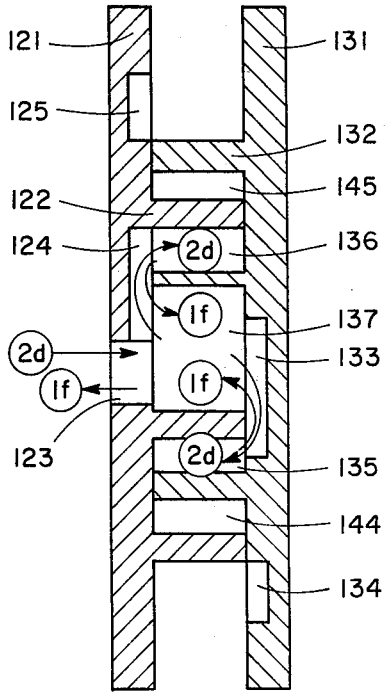
Figure 57:
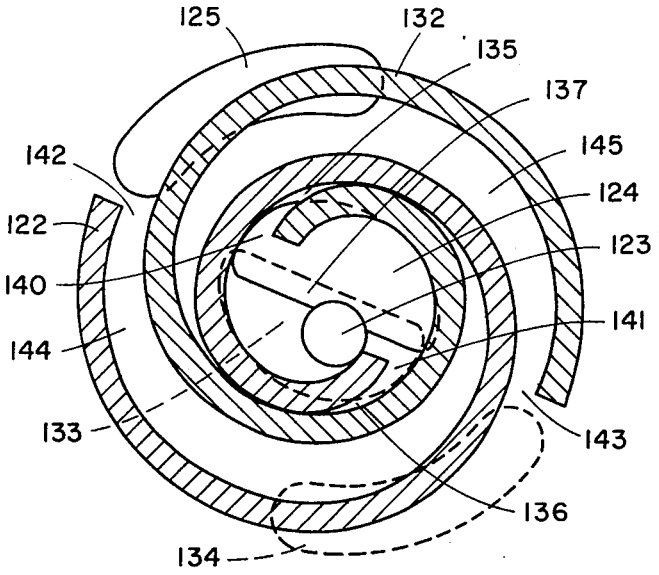
Figure 58:
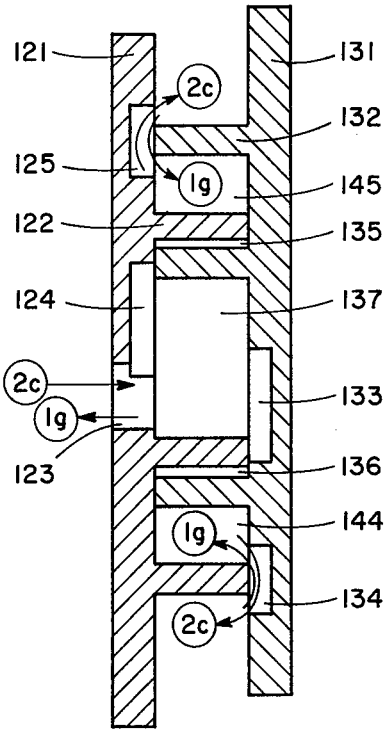
Figure 59:
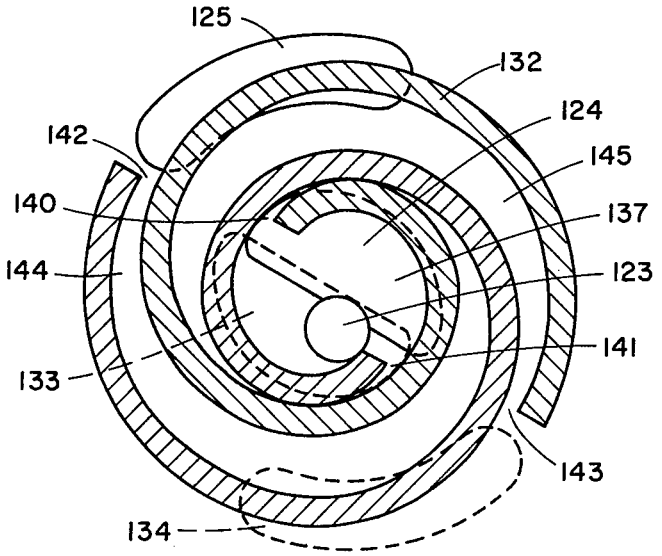
Figure 60:
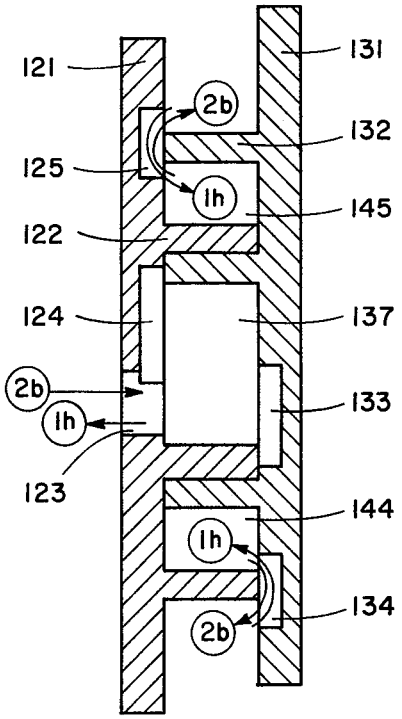

In order to follow the operation of the porting system of this invention as it functions in the second mode, i.e., pumping liquid radially outward, it is necessary to begin with FIGS. 45 and 46 and then follow the figures in reversed pair order from FIGS. 59 and 60 back through FIGS. 47 and 48. The peripheral transfer passages 125 and 134 augment the peripheral wrap passages 142 and 143 during late liquid discharge (FIGS. 59 and 60 and FIGS. 57 and 58) as they did in the case shown in FIGS. 27–30. During this period of the cycle the center pocket 137 is in essence one with pockets 135 and 136, so communication among these pockets presents no problem. The flow of liquid into the central pocket gradually causes the differentiation among pockets 135, 136 and 137 and the presence of center transfer passages 124 and 133 provides for a smooth flow of liquid into these forming pockets and increases the hydraulic force which acts on the wraps to maintain good moving line contacts between their flanks. This situation continues (FIGS. 55 and 56 through FIGS. 47 and 48); and as the center wrap passages 140 and 141 continue to decrease, the role of the open center transfer passages 124 and 133 becomes more important in insuring a smooth nonpulsating flow of liquid through inlet port 123 and center pocket 137 into pockets 135 and 136. With the closing of these pockets as shown in FIGS. 45 and 46, the scroll wraps have been brought around through another cycle and are in a position to discharge liquid to the peripheral volume 138 with the reopening of peripheral transfer passages 125 and 134.

Although it is possible to operate the scroll members of FIGS. 1–4 and of FIGS. 21–24 in either the radially inward or radially outward mode, for most applications, and particularly for larger scroll devices running at relatively high speeds, it is preferable to use the scroll members of FIGS. 41–44, that is those having both central or inner and peripheral or outer recessed transfer passages.

FIG. 61 is a longitudinal cross section of a scroll liquid pump incorporating the scroll elements and porting system of this invention. The scroll members illustrated are those incorporating the scroll elements of FIGS. 42–44 at that point of their pumping cycle shown in FIGS. 51 and 52. The same reference numerals used to identify components of the fixed and orbiting scrolls and the pockets defined by them used in FIGS. 41–44, 51 and 52 are used in FIG. 61.

The pump of FIG. 61 is comprised of a stationary scroll member 150 formed of a stationary plate 151 in which stationary scroll element 120 is rigidly mounted; and orbiting scroll member 152 formed of an orbiting plate 153 in which orbiting scroll 130 is rigidly mounted, a coupling member 154, a drive mechanism generally indicated by reference numeral 155; crank and shaft assembly means generally indicated by reference numeral 156; housing 157 including an oil sump 158, cooling fan 159 and cover 160.

Stationary plate 151 of the stationary scroll member terminates in a peripheral ring 165 and an outwardly extending flange 166, these portions of plate 151 forming a part of the apparatus housing. Stationary plate 151 also has a central stub extension 167 defining a liquid passage 168 in direct communication with central port 123 of the stationary scroll, these making up a liquid conduit means which may serve as a liquid inlet or discharge conduit depending upon the mode of operation chosen. Boss 79 of stationary scroll 120 extends into extension 167 and is sealed therein through o-ring 169. Central stub extension 167 is internally threaded at 170 for engagement with a liquid conduit (not shown). Stationary plate 151 also has one or more peripherally positioned stub extensions 175 each of which defines a liquid inlet or discharge conduit means 176 communicating with the peripheral zone 138 and being threaded at 177 for engagement with a liquid conduit (not shown).

The diameter of orbiting plate 153 of the orbiting scroll member is sufficiently great such that it always extends beyond the inner edge of flange 166, thus permitting, if desired, the placement of an oil seal ring 180 between plate 153 and flange 166 to seal off the scroll pockets from the remainder of the apparatus. This in turn allows the drive mechanism and bearings to be oil-lubricated while maintaining the working fluid substantially free from any liquid. In those applications where the liquid being pumped is itself capable of serving as a lubricant, then oil seal ring 180 may be omitted.

The housing, generally indicated by the reference numeral 157, is comprised of ring extension 165 of the stationary scroll member, flange 166, main housing section 181 which is flanged at 187 and is integral with a lower oil sump housing 183. The housing is attached and sealed to the scroll members through flanges 166 and 182 by a plurality of bolts 184 using an o-ring seal 185.

In operation, the two scroll members must be maintained in a fixed angular relationship, and this is done through the use of coupling member 154. The coupling member illustrated in the apparatus embodiment of FIG. 61 is essentially the same as the coupling member described in U.S. Pat. No. 3,994,633 (see FIG. 14 of that patent and the detailed description thereof). Thus as seen in FIG. 61, the coupling member comprises a ring 190 having oppositely disposed keys 191 on one side thereof slidingly engaging keyways 192 in the inner surface of housing flange 182. A second pair of keys (not shown) are oppositely disposed on the other side of coupling ring 68 to slidingly engage keyways (not shown) in plate 153 of the orbiting scroll member. Another embodiment of a suitable coupling member is described and claimed in copending application Ser. No. 722,713, filed Sept. 13, 1976, in the name of John E. McCullough and assigned to the same assignee.

Orbiting scroll member 152 has a stub shaft 195 affixed to or integral with orbiting plate 153. The orbiting scroll member is driven by a motor (not shown) external of the housing and engageable with compressor shaft 196 extending into the housing through an oil seal 197 and terminating in a crank plate 198 which may be affixed to or integral with shaft 196. Shaft 196 is mounted in the housing through shaft bearing 199 and crank bearing 200.

The driving means of the scroll apparatus is that described in copending application Ser. No. 761,889 filed in the name of John E. McCullough, now U.S. Pat. No. 4,082,484, and is a fixed throw crank mechanism. The orbiting scroll member is affixed to drive shaft 196 through bearing mount 201, configured to have a counterweight 202 for the purpose of balancing the centrifugal force of the orbiting scroll member. Bearing mount 201 engages the stub shaft 195 through needle bearing 203 held in place by a snap ring (not shown). Interposed between bearing mount 201 and the outer surface of orbiting plate 153 of the orbiting scroll member is a thrust face bearing 205 which acts as the axial force-applying means to urge the end plates and wrap ends of the two scroll members together to realize the desired degree of axial sealing. Thrust face bearing 205 carries the load from orbiting scroll member 152 through the crank bearing 200 and subsequently to the housing.

Main shaft 196, crank plate 198, bearing mount 201 and counterweight 202 make up an adjustable fixed-throw drive mechanism for the scroll pump of this invention. As noted above, the fact that in liquid pumps the liquid being handled has a greater viscosity than a gas in a compressor or expander and that the volume ratio maintained is one makes it possible to operate with a small clearance between the flanks of the scroll wraps. This makes it possible to use a fixed throw crank in driving the orbiting scroll member and to arrange a predetermined clearance between the flanks. Thus in affixing the orbiting scroll member to crank plate 198, provision is made to adjust the position of the wrap of the orbiting scroll member relative to the wrap of the stationary scroll member. This is accomplished by adjusting the position of the bearing mount 201/counterweight 202 assembly relative to crank plate 198 through the use of pivot pin 206 and locking screws 207 (preferably four) which extend through slots 208 in the bearing mount 201/counterweight 202 assembly into threading in crank plate 198. This mechanism is shown in detail in FIG. 7 of U.S. Pat. No. 4,082,484. In the embodiment described and shown in that FIG. 7, slots 208 are so configured as to permit the bearing mount 201/counterweight 202 assembly to be moved through a small arc prior to locking this assembly to crank plate 198 by means of screws 207.

Figure 8:
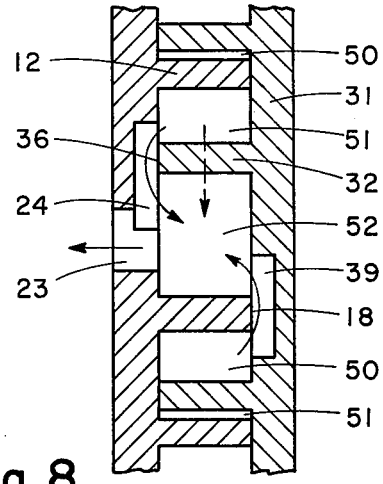
Figure 9:
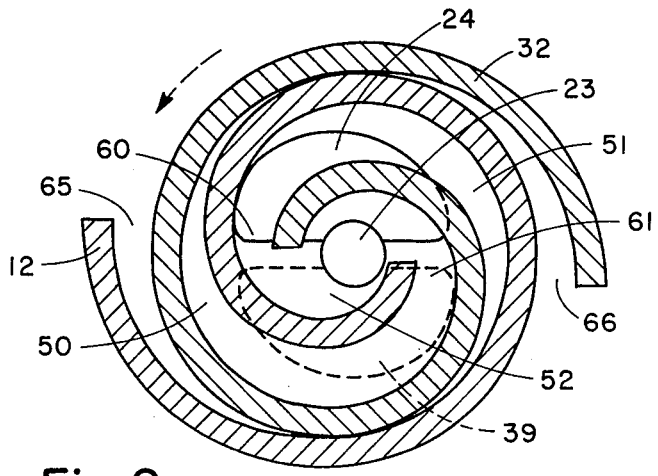
Figure 10:
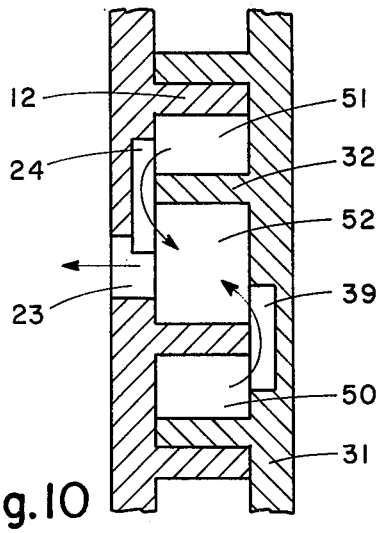
Figure 11:
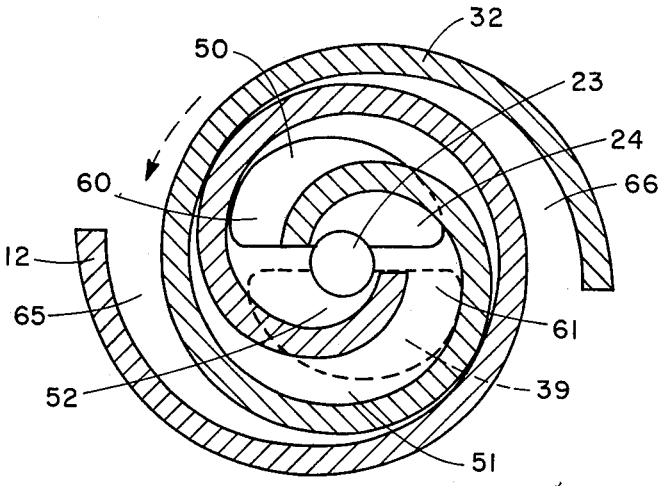
Figure 12:
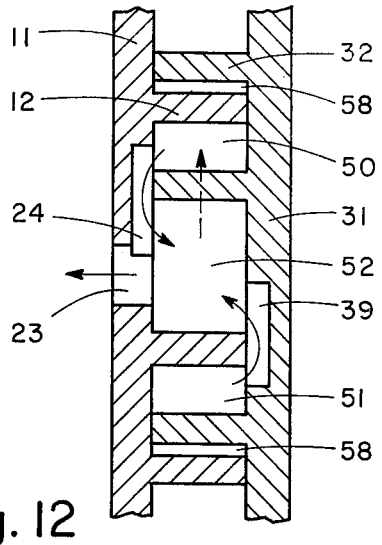
Figure 13:
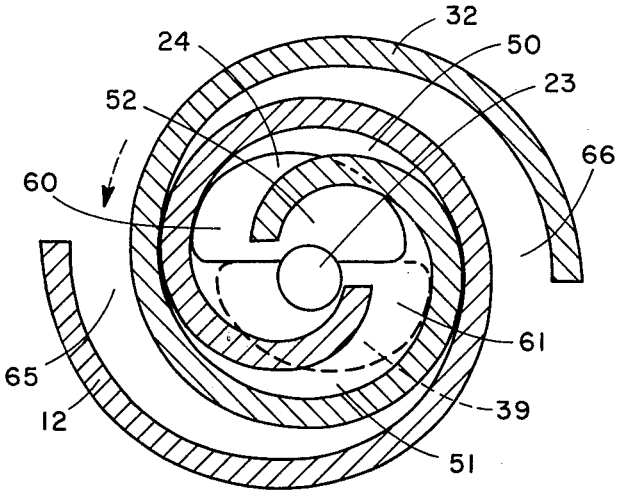
Figure 14:
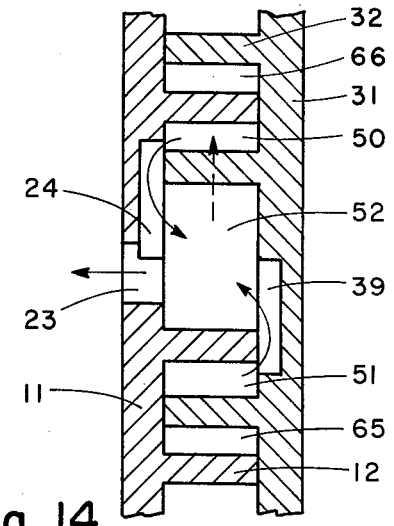
Figure 15:
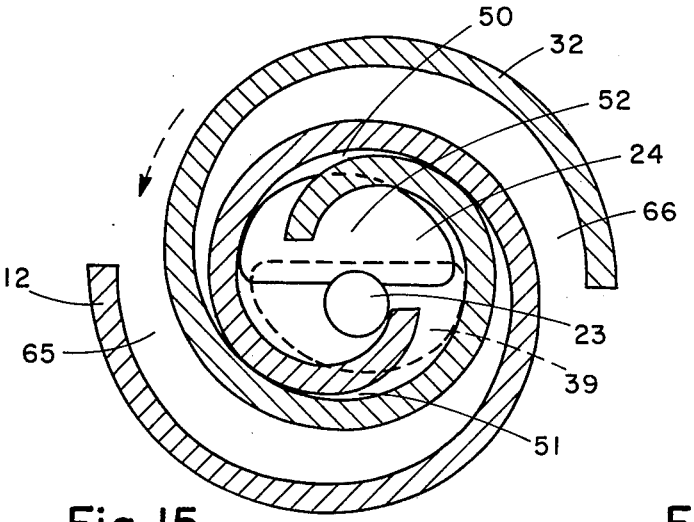
Figure 16:
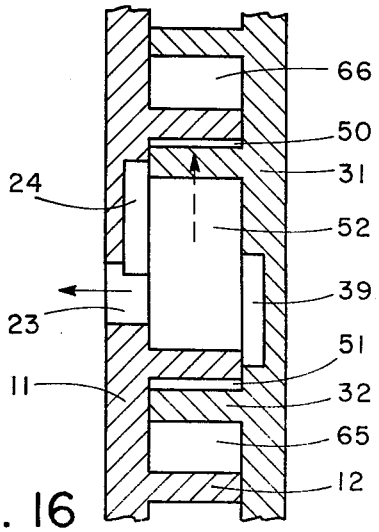
Figure 17:
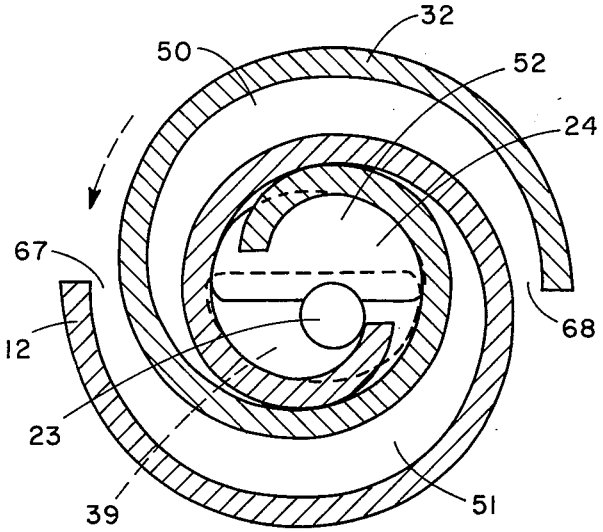
Figure 18:
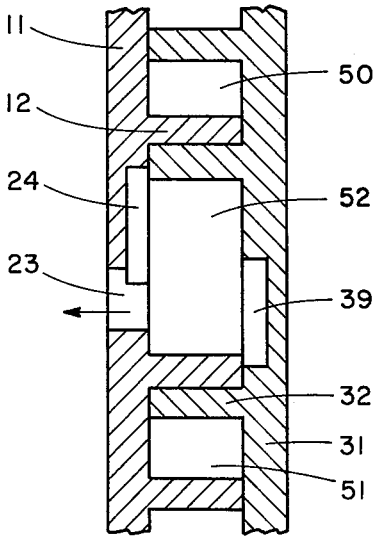
Figure 19:
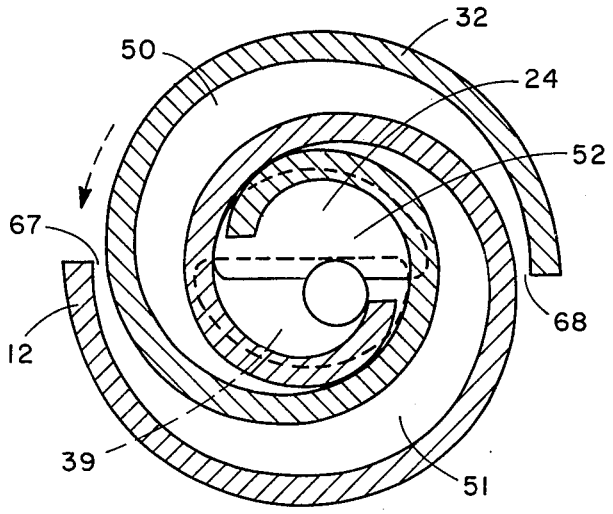
Figure 20:
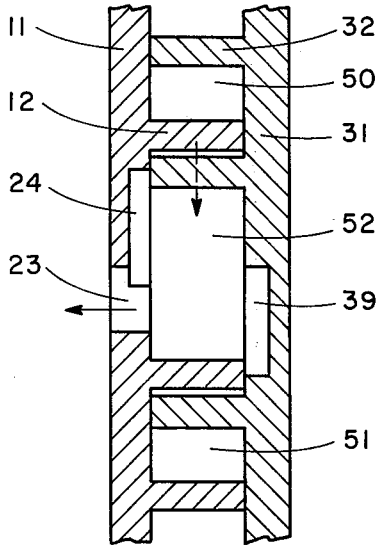
Figure 22:
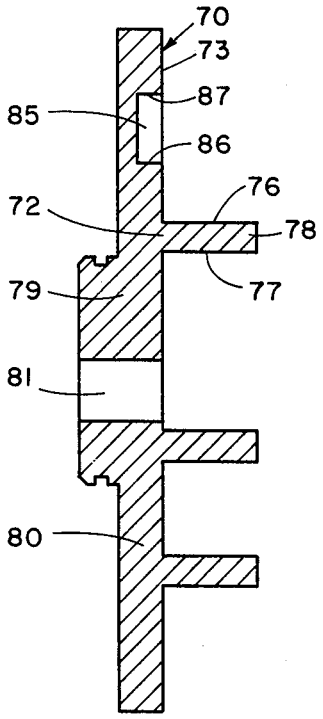
FIGS. 21 and 22 are top plan and cross sectional views of another embodiment of a stationary scroll element constructed in accordance with this invention and being particularly suited for use in a scroll liquid pump in which the liquid flow is outwardly directed.

FIG. 61 illustrates an adjustable fixed-throw crank; is also possible to use a fixed-throw crank which is not adjustable, that is one which is designed and constructed to have the bearing mount 201/counterweight 202 assembly initially and permanently affixed to crank plate 198 such that the desired clearance between the wraps of the orbiting and stationary scroll members is defined. In such an arrangement, the bearing mount 201/counterweight 202 assembly may be affixed to crank plate 198 through two or more screws as shown in FIG. 8 of U.S. Pat. No. 4,082,484.

It has been found that by leaving a clearance 204 between the wraps of the scroll members, wearing of the wraps may be substantially reduced or even eliminated and that special machining of the wraps is unnecessary. In operation, it is preferred that the clearance 204 between the flanks of the scroll member wraps, which is equivalent to clearance 100 shown in FIG. 2 of U.S. Pat. No. 4,082,484, be kept between about 0.001 and 0.005 inch. The clearance between the wraps may be established in one of several ways. In assembling the apparatus, a thin shim of metal of a thickness equivalent to the clearance may be inserted between the wraps and then subsequently removed when locking screws 207 are tightened. Alternatively, the orbit radius of the scroll members may be measured during a trial assembly and the orbit radius of the drive crank assembly set at this value minus the desired flank clearance. For any given liquid pump design and size, it will generally be convenient to operate the apparatus to determine what orbit radius is desired (equivalent to the distance between the machine axis 210 and orbiting scroll member axis 211); and then set bearing mount 201 at an orbit radius slightly less than that at which wrap-to-wrap line contacts occur.

The actual magnitude of the clearance finally left between the wraps is normally dependent, at least to some extent, on the size of the liquid pump and the viscosity of the liquid being pumped. In general, the larger the pump and the more viscous the liquid, the larger may be the clearance.

As noted above with regard to the general description of the apparatus illustrated in FIG. 61, there is provided an oil sump 158 in lower section 183 of the apparatus housing. The lubricating oil 212 from sump 158 is delivered to coupling member 154 and to the various shaft and drive bearings within housing 157 by means of one or more oil fingers 213 affixed to the coupling member. These oil fingers are of a length such that they are periodically dipped into oil 212 and then raised to fling the oil upward within the housing for circulation and return into the oil sump. An oil passage 214 is provided to conduct some of the oil flung directly into housing cavity 215, which surrounds the crank plate and bearing mount, to shaft bearing 199. In those cases where the pump is used to pump a liquid which in itself can serve as a lubricant and the oil seal ring 180 is not included, it is not necessary to have oil fingers 213 since the entire housing will normally contain liquid throughout substantially its entire volume.

Under some conditions of operation, e.g., pumping a liquid at an elevated temperature, it may be desirable to provide means to air cool the compressor housing, and through the housing to cool the elements of the pump and the circulating lubricating oil. Such means are illustrated in FIG. 61. An air duct 216, terminating in a duct cover 217, is mounted around the apparatus housing and supported on the drive end of a plurality of housing fin members 218. Cooling air is circulated through the air duct 216 by means of fan 159 which comprises a plurality of fan blades 219 mounted between the outer, belt-engaging rim 220 and the inner shaft engaging ring 221 of a pulley 222. Pulley 222 is affixed to main shaft 196 through a key 223 engagable with keyway 224 in shaft 196. Duct cover 217 is affixed to the scroll member end of the housing fin members 228, and it terminates short of covering the scroll member end in order to leave a series of air discharge openings 225 so that air drawn in by fan 159 is circulated over the apparatus housing from drive end to scroll member end and discharged through openings 225.

A liquid pump was constructed as shown in FIG. 61 having the stationary and orbiting scroll elements of FIGS. 1–4. Sealing ring 180, oil fingers 213 and housing cooling means were omitted. This pump was operated at 900 rpm and was found to pump SAE 20 hydraulic oil with an efficiency approximately equal to that of a gear pump of about the same capacity. The pump ran quietly and was free of pressure pulsations.

It will thus be seen that the objects set forth above, among those made apparent from the preceding description, are efficiently attained and, since certain changes may be made in the above constructions without departing from the scope of the invention, it is intended that all matter contained in the above description or shown in the accompanying drawings shall be interpreted as illustrative and not in a limiting sense.

I claim:

1. A scroll element suitable for forming a scroll member in a liquid scroll pump, comprising in combination (a) an end plate;

(b) an involute wrap of one and one-half involute turns affixed to one surface of said end plate; and (c) recessed liquid transfer passage means cut in said one surface of said end plate, said recessed liquid transfer passage means being defined along one principal boundary by a partial tracing of an involute wrap edge of a mating scroll element.

2. A scroll element in accordance with claim 1 wherein said recessed liquid transfer passage means approximates the thickness of said involute wrap in depth.

3. A scroll element in accordance with claim 1 wherein said recessed liquid transfer passage means is located within said involute wrap and has as another principal boundary a straight line drawn through the center of said end plate and parallel to a line of contact drawn as a tangent to the generating radius of said involute wrap.

4. A scroll element in accordance with claim 1 wherein said recessed liquid transfer passage means is located outside said involute wrap and has as another principal boundary a line following the same contour as said one principal boundary and spaced radially outward therefrom.

5. A scroll element in accordance with claim 4 wherein said another principal boundary is spaced a distance approximately two involute wrap thicknesses from said one principal boundary.

6. A scroll element in accordance with claim 4 wherein said recessed liquid transfer passage means extends through an arc of between about 45 and 90 degrees.

7. A scroll element in accordance with claim 1 wherein said recessed liquid transfer passage means comprises (a) an inner recessed transfer passage located within said involute wrap and having one principal boundary defined by a partial tracing of an involute wrap edge of a mating scroll element and another principal boundary defined by a line drawn through the center of said end plate and parallel to a line of contact drawn as a tangent to the generating radius of said involute wrap; and (b) an outer recessed transfer passage located outside said involute wrap and having one principal boundary defined by a partial tracing of an involute wrap edge of said mating scroll element and another principal boundary defined by a line following the same contour as said partial tracing of said second involute wrap edge and spaced radially outward therefrom by a distance approximately two involute wrap thicknesses.

8. A scroll element in accordance with claim 7 wherein the depth of said recessed liquid transfer passage means approximates the thickness of said involute wrap.

9. A scroll element in accordance with claim 7 wherein said outer recessed liquid transfer passage extends through an arc of between about 45 and 90 degrees.

10. Mating scroll elements suitable for incorporation in a scroll liquid pump, comprising in combination (a) a first scroll element arranged to be maintained stationary within said pump and comprising (1) a first end plate, (2) a first involute wrap of one and one-half involute turns affixed to one surface of said first end plate, and (3) first recessed liquid transfer passage means cut in said one surface of said first end plate; and (b) a second scroll element arranged to be orbited within said pump with respect to said first scroll element and to define therewith moving liquid pockets and a liquid discharge zone, said second scroll element comprising (1) a second end plate, (2) a second involute wrap of one and one-half involute turns affixed to one surface of said second end plate, and (3) a second recessed liquid transfer passage means cut in said one surface of said second end plate; said first and second recessed liquid transfer passage means being located and configured to be opened to said liquid discharge zone by the orbiting motion of said second scroll element substantially immediately after said second involute wrap has reached that point in its orbiting cycle to define three essentially sealed-off liquid pockets.

11. Mating scroll elements in accordance with claim 10 wherein said first recessed liquid transfer passage means is defined along one principal boundary by a partial tracing of said second involute wrap edge and said second recessed liquid transfer passage means is defined along one principal boundary by a partial tracing of said first involute wrap edge.

12. Mating scroll elements in accordance with claim 11 wherein said first and second recessed liquid transfer passage means are located within said first and second involute wraps, respectively, and have as another principal boundary a straight line drawn through the center of said first and second end plates, respectively, and parallel to a line of contact drawn as a tangent to the generating radius of said first and second involute wraps, respecitvely.

13. Mating scroll elements in accordance with claim 11 wherein said first and second recessed liquid transfer passage means are located outside said first and second involute wraps, respectively, and have as another principal boundary a line following the same contour as said one principal boundary and spaced radially outward therefrom.

14. Mating scroll elements in accordance with claim 10 wherein each of said recessed liquid transfer passage means in each of said first and second scroll elements comprises, in combination (a) an inner recessed transfer passage located within said involute wrap and having one principal boundary defined by a partial tracing of the involute wrap edge of the mating scroll element and another principal boundary defined by a line drawn through the center of said end plate and parallel to a line of contact drawn as a tangent to the generating radius of said involute wrap; and (b) an outer recessed transfer passage located outside said involute wrap and having one principal boundary defined by a partial tracing of the involute wrap edge of the mating scroll element and another principal boundary defined by a line following the same contour as said partial tracing of the mating involute wrap edge and spaced radially outward therefrom.

15. Mating scroll elements in accordance with claim 14 wherein the depth of said inner and outer recessed transfer passages approximates the thickness of said involute wrap, said another principal boundary of said outer recessed transfer passage is spaced from said one principal boundary by a distance equal to about two wrap thicknesses and said outer recessed transfer passage extends through an arc between about 45 and 90 degrees.

16. Mating scroll members suitable for incorporation in a scroll liquid pump, comprising in combination (a) a stationary scroll member having a central liquid port and comprising (1) a stationary end plate, (2) a stationary involute wrap of one and one-half involute turns affixed to one surface of said stationary end plate, and (3) stationary recessed liquid transfer passage means cut in said one surface of said stationary end plate; and (b) an orbiting scroll member arranged to be orbited with respect to said stationary scroll member by driving means and comprising (1) an orbiting end plate, (2) an orbiting involute wrap of one and one-half involute turns affixed to one surface of said orbiting end plate, and (3) orbiting recessed liquid transfer passage means cut in said one surface of said orbiting end plate; whereby when said orbiting scroll member is driven by said driving means said stationary and said orbiting involute wraps define moving liquid pockets of variable volume, a peripheral volume around said pockets and a discharge zone; said stationary and said orbiting recessed liquid transfer passage means being located and configured to be opened to said discharge zone substantially immediately after said orbiting involute wrap has reached that point in its orbiting cycle to define three essentially completely sealed-off liquid pockets and to remain open at least until the liquid passages defined by the orbiting of said orbiting wrap and providing liquid communication into said liquid discharge zone are sufficiently large to prevent any substantial pressure pulsations within the scroll liquid pump.

17. Mating scroll members in accordance with claim 16 wherein said stationary recessed liquid transfer passage means is defined along one principal boundary by a partial tracing of said orbiting involute wrap edge and said orbiting recessed liquid transfer passage means is defined along one principal boundary by a partial tracing of said stationary involute wrap edge.

18. Mating scroll members in accordance with claim 17 wherein said stationary and orbiting recessed liquid transfer passage means are located within said stationary and orbiting involute wraps, respectively, and have as another principal boundary a straight line drawn through the center of said stationary and orbiting end plates, respectively, and parallel to a line of contact drawn as a tangent to the generating radius of said stationary and orbiting involute wraps, respectively.

19. Mating scroll members in accordance with claim 18 wherein the inner pocket of said liquid pockets serves as said discharge zone, and the flow of liquid through said scroll members is radially inward.

20. Mating scroll members in accordance with claim 16 wherein said stationary and orbiting recessed liquid transfer passage means are located outside said stationary and orbiting involute wraps, respectively, and have as another principal boundary a line following the same contour as said one principal boundary and spaced radially outward therefrom.

21. Mating scroll members in accordance with claim 20 wherein said peripheral volume serves as said discharge zone, and the flow of liquid through said scroll members is radially outward.

22. Mating scroll members in accordance with claim 16 wherein each of said recessed liquid transfer passage means in each of said stationary and orbiting scroll members comprises, in combination (a) an inner recessed transfer passage located within said involute wrap and having one principal boundary defined by a partial tracing of the involute wrap edge of the mating scroll member and another principal boundary defined by a line drawn through the center of said end plate and parallel to a line of contact drawn as a tangent to the generating radius of said involute wrap; and (b) an outer recessed transfer passage located outside said involute wrap and having one principal boundary defined by a partial tracing of the involute wrap edge of the mating scroll member and another principal boundary defined by a line following the same contour as said partial tracing of the mating involute wrap edge and spaced radially inwardly therefrom, and either the inner pocket of said liquid pockets or said peripheral volume serves as said discharge zone.

23. Mating scroll elements in accordance with claim 22 wherein the depth of said inner and outer recessed transfer passages approximates the thickness of said involute wrap, said another principal boundary of said outer recessed transfer passage is spaced from said one principal boundary by a distance equal to about two wrap thicknesses and said outer recessed transfer passage extends through an arc between about 45 and 90 degrees.

24. In a positive displacement liquid pump into which a liquid is introduced through an inlet port for circulation through said apparatus and subsequently withdrawn through a discharge port, and comprising a stationary scroll member having an end plate and an involute wrap of one and one-half involute turns affixed to one surface of said end plate of said stationary scroll member and a mating orbiting scroll member having an end plate and an involute wrap of one and one-half involute turns affixed to one surface of said end plate of said orbiting scroll member, driving means for orbiting said orbiting scroll member with respect to said stationary scroll member whereby said involute wraps define moving liquid pockets of variable volume, a peripheral volume around said pockets and a discharge zone; coupling means to maintain said scroll members in fixed angular relationship; axial force-applying means for providing an axial force to urge said involute wrap of said stationary scroll member into axial contact with said end plate of said orbiting scroll member and said involute wrap of said orbiting scroll member into axial contact with said end plate of said stationary scroll member thereby to achieve radial sealing of said pockets, characterized in that said stationary and said orbiting scroll members each have recessed liquid transfer passage means cut in said one surface of their respective end plates, said liquid transfer passage means being located and configured to be opened to said discharge zone substantially immediately after said involute wrap and said orbiting scroll member has reached that point in its orbiting cycle to define three essentially completely sealed-off liquid pockets and to remain open at least until the liquid passages defined by the orbiting of said involute wrap of said orbiting scroll member and providing liquid communication into said liquid discharge zone are sufficiently large to prevent any substantial pressure pulsations within said pump.

25. A liquid pump in accordance with claim 24 wherein said recessed liquid transfer passage means in each of said scroll members is defined along one principal boundary by a partial tracing of the involute wrap edge of the other of said scroll members.

26. A liquid pump in accordance with claim 25 wherein said recessed liquid transfer passage means are located within said involute wrap and have as another principal boundary a straight line drawn through the center of said end plate and parallel to a line of contact drawn as a tangent to the generating radius of said involute wrap.

27. A liquid pump in accordance with claim 26 wherein the inner pocket of said liquid pockets serves as said discharge zone, and the flow of liquid through said pump is radially inward.

28. A liquid pump in accordance with claim 25 wherein said recessed liquid transfer passage means are located outside said involute wrap and have as another principal boundary a line following the same contour as said one principal boundary and spaced radially inward therefrom.

29. A liquid pump in accordance with claim 28 wherein said peripheral volume serves as said discharge zone, and the flow of liquid through said pump is radially outward.

30. A liquid pump in accordance with claim 24 wherein said recessed liquid transfer passage means of said stationary and orbiting scroll members each comprises in combination (1) an inner recessed transfer passage located within said involute wrap and having one principal boundary defining a partial tracing of the involute wrap edge of the mating scroll member and another principal boundary defined by a line drawn through the center of said end plate and parallel to a line of contact drawn as a tangent to the generating radius of said involute wrap; and (2) an outer recessed transfer passage located outside said involute wrap and having one principal boundary defined by a partial tracing of the involute wrap edge of the mating scroll member and another principal boundary defined by a line following the same contour as said partial tracing of the mating involute wrap edge and spaced radially outward therefrom, and either the inner pocket of said liquid pockets or said peripheral volume serves as said discharge zone.

31. A liquid pump in accordance with claim 30 wherein the depth of said inner and outer recessed transfer passages approximates the thickness of said involute wrap, said another principal boundary of said outer recessed transfer passage is spaced from said one principal boundary by a distance equal to about two wrap thicknesses and said outer recessed transfer passage extends through an arc between about 45 and 90 degrees.

32. A positive displacement liquid pump, comprising in combination (a) a stationary scroll member having an end plate, an involute wrap of one and one-half involute turns and recessed liquid transfer passage means cut in said end plate;

(b) a mating orbiting scroll member having an end plate, an involute wrap of one and one-half involute turns and recessed liquid transfer passage means cut in said end plate;

(c) axial force applying means arranged to urge said scroll members into axial contact;

(d) coupling means to maintain said scroll members in fixed angular relationship;

(e) liquid inlet conduit means and liquid discharge conduit means; and (f) driving means for orbiting said orbiting scroll member whereby the side flanks along with said end plates of said involute wraps define moving liquid pockets of variable volume, a peripheral volume around said pockets and a discharge zone;

said recessed liquid transfer passage means being cut in one surface of said end plates of said stationary and orbiting scroll members and being located and configured to be opened to said discharge zone substantially immediately after said involute wrap of said orbiting scroll member has reached that point in its orbiting cycle to define three essentially completely sealed-off liquid pockets and to remain open at least until the liquid passages defined by the orbiting of said involute wrap of said orbiting scroll member and providing liquid communication into said liquid discharge zone are sufficiently large to prevent any substantial pressure pulsations within said pump.

33. A liquid pump in accordance with claim 32 wherein said recessed liquid transfer passage means in each of said scroll members is defined along one principal boundary by a partial tracing of the involute wrap edge of the other of said scroll members.

34. A liquid pump in accordance with claim 33 wherein said liquid transfer passage means are located within said involute wraps, and have as another principal boundary a straight line drawn through the center of said end plates and parallel to a line of contact drawn as a tangent to the generating radius of said first and second involute wraps.

35. A liquid pump in accordance with claim 34 wherein said liquid inlet conduit means communicates with said peripheral volume and said liquid discharge conduit means communicates with the inner pocket of said liquid pockets which serves as said discharge zone.

36. A liquid pump in accordance with claim 33 wherein said recessed liquid transfer passage means are located outside said involute wraps and have as another principal boundary a line following the same contour as said one principal boundary and spaced radially outward therefrom.

37. A liquid pump in accordance with claim 36 wherein said liquid inlet conduit means communicates with the inner pocket of said liquid pockets and said liquid discharge conduit means communicates with said peripheral volume which serves as said discharge zone.

38. A liquid pump in accordance with claim 32 wherein each of said recessed liquid transfer passage means in each of said stationary and orbiting scroll members comprises, in combination (1) an inner recessed transfer passage located within said involute wrap and having one principal boundary defined by a partial tracing of the involute wrap edge of the mating scroll member and another principal boundary defined by a line drawn through the center of said end plate and parallel to a line of contact drawn as a tangent to the generating radius of said involute wrap; and (2) an outer recessed transfer passage located outside said involute wrap and having one principal boundary defined by a partial tracing of the involute wrap edge of the mating scroll element and another principal boundary defined by a line following the same contour as said partial tracing of the mating involute wrap edge and spaced radially outward therefrom; and, wherein said liquid inlet conduit means communicates with said peripheral volume and said liquid discharge conduit means with the inner pocket of said liquid pockets in which case the liquid flow through said pump is radially inward, or said liquid inlet conduit means communicates with said inner pocket and said liquid discharge conduit with said peripheral volume in which case the liquid flow is radially outward.

39. A liquid pump in accordance with claim 38 wherein the depth of said inner and outer recessed transfer passages approximates the thickness of said involute wrap, said another principal boundary of said outer recessed transfer passage is spaced from said one principal boundary by a distance equal to about two wrap thicknesses and said outer recessed transfer passage extends through an arc between about 45° and 90°.

40. A liquid pump in accordance with claim 32 wherein said driving means is arranged to effect the orbiting of said orbiting scroll member such that a small clearance is maintained between the side flanks of said involute wraps thereby to essentially eliminate wear of said side flanks over extended periods of operation while retaining the essential integrity of said liquid pockets.

41. A liquid pump in accordance with claim 40 wherein said driving means comprise, in combination (a) a drive shaft terminating in a crank plate and rotatable on a machine axis;

(b) a stub shaft extending from said orbiting scroll member, having bearing mount and counterweight means rigidly affixed thereto and rotatable on an axis parallel with and spaced from said machine axis by a distance equivalent to the orbit radius of said orbiting scroll member; and (c) locking means to rigidly affix said bearing mount and counterweight means to said crank plate in a predetermined relation thereby to define said clearance.

42. A liquid pump in accordance with claim 41 wherein said axial force applying means comprises thrust bearing means acting between said bearing mount and counterweight means and said end plate of said orbiting scroll member.

43. A liquid pump in accordance with claim 32 including housing means defining the outer limits of said peripheral volume and providing an enclosure in which are located said scroll members, driving means and coupling means.

44. A liquid pump in accordance with claim 43 including means to circulate lubricating oil within said housing means.

45. A liquid pump in accordance with claim 44 including oil seal ring means arranged to seal off said fluid pockets whereby no appreciable amount of said lubricating oil enters said liquid pockets and said peripheral volume.

46. A liquid pump in accordance with claim 43 including fluid duct means defining around said housing a fluid passage, and means for circulating a cooling fluid through said fluid passage.

* * * * *